US007975445B2

(12) United States Patent
Parshad et al.

(10) Patent No.: US 7,975,445 B2
(45) Date of Patent: Jul. 12, 2011

(54) OFFICE PARTITION SYSTEM

(75) Inventors: David Parshad, Markham (CA); Peter Woronecki, Holland Landing (CA); Ivan Liu, Markham (CA)

(73) Assignee: Inscape Corporation, Holland Landing, Ontario (CA)

( * ) Notice: Subject to any disclaimer, the term of this patent is extended or adjusted under 35 U.S.C. 154(b) by 93 days.

(21) Appl. No.: 12/457,302

(22) Filed: Jun. 5, 2009

(65) Prior Publication Data

US 2010/0307080 A1 Dec. 9, 2010

(30) Foreign Application Priority Data

Jun. 5, 2009 (CA) ..... 2668445

(51) Int. Cl.
*E04B 2/74* (2006.01)

(52) U.S. Cl. ..... 52/239; 52/36.1; 52/220.7; 52/481.2

(58) Field of Classification Search ..... 52/36.1, 52/36.4, 36.5, 220.7, 238.1, 239, 481.1, 481.2, 52/483.1; 108/50.1, 50.2, 152, 137, 143; 211/184; 160/351
See application file for complete search history.

(56) References Cited

U.S. PATENT DOCUMENTS

| | | | | | |
|---|---|---|---|---|---|
| 756,749 | A | | 4/1904 | Watts | |
| 3,612,291 | A | * | 10/1971 | Skubic | 211/208 |
| 3,802,146 | A | | 4/1974 | Tacke | |
| 3,807,102 | A | | 4/1974 | Albinson | |
| 3,849,962 | A | | 11/1974 | Albinson | |
| 3,862,524 | A | * | 1/1975 | McCrackin | 52/36.4 |
| 4,269,005 | A | | 5/1981 | Timmons | |
| 4,424,654 | A | | 1/1984 | Anderson | |
| 4,611,448 | A | | 9/1986 | DeLong | |
| 4,891,922 | A | | 1/1990 | Hozer | |
| 4,898,285 | A | | 2/1990 | Field | |
| 4,914,878 | A | * | 4/1990 | Tamaki et al. | 52/239 |
| 4,947,601 | A | | 8/1990 | McGuire | |
| 4,949,519 | A | | 8/1990 | Jeffers | |
| 5,026,588 | A | | 6/1991 | Diekmann | |
| 5,056,577 | A | | 10/1991 | DeLong | |
| 5,069,263 | A | | 12/1991 | Edwards | |
| 5,175,969 | A | * | 1/1993 | Knauf et al. | 52/239 |
| 5,195,286 | A | | 3/1993 | DeLong | |
| 5,209,035 | A | | 5/1993 | Hodges | |
| 5,219,406 | A | | 6/1993 | Raz | |
| 5,277,006 | A | | 1/1994 | Ruster | |
| 5,325,904 | A | | 7/1994 | Leitner | |
| 5,341,615 | A | | 8/1994 | Hodges | |
| 5,347,778 | A | | 9/1994 | Bray | |
| 5,377,851 | A | * | 1/1995 | Asano et al. | 211/191 |

(Continued)

*Primary Examiner* — Robert J Canfield
*Assistant Examiner* — Babajide Demuren
(74) *Attorney, Agent, or Firm* — Riches, McKenzie & Herbert LLP

(57) ABSTRACT

A partition with a frame having two vertical end post members spanned by beam members with each end post member having an internally directed longitudinal slotway open towards the other end post member and within which the ends of the beam members are received and, preferably, with the end post members having a front to back width greater than the front to back width of the beam members such that vertical raceways are defined between the post members outward of the beam members and inward of removable cladding panels coupled to each front and back of the frame outward of the post members. Preferably, channelways through each post member, preferably at the upper and/or lower ends of each post member, provide for access to the vertical raceways via horizontal raceways extending between the posts above and below each beam.

21 Claims, 36 Drawing Sheets

U.S. PATENT DOCUMENTS 5,406,760 A 4/1995 Edwards
5,487,246 A 1/1996 Hodges
5,586,593 A 12/1996 Schwartz
5,642,593 A 7/1997 Shieh
5,737,887 A 4/1998 Smeenge
5,813,178 A 9/1998 Edwards
5,899,035 A * 5/1999 Waalkes et al. ..... 52/239
5,905,229 A 5/1999 McKitrick
5,913,787 A 6/1999 Edwards
5,918,433 A 7/1999 Reuter
6,002,089 A 12/1999 Hemingway
6,009,675 A 1/2000 Waalkes
6,079,173 A * 6/2000 Waalkes et al. ..... 52/239
6,088,981 A 7/2000 Edwards
6,098,358 A 8/2000 Waalkes
6,101,773 A 8/2000 Chau
6,115,977 A 9/2000 Hornberger
6,131,347 A 10/2000 Hornberger
6,158,180 A 12/2000 Edwards
6,167,665 B1 1/2001 Dame
6,173,536 B1 1/2001 Boyce
6,178,702 B1 1/2001 Hand
6,202,381 B1 3/2001 Dame
6,209,273 B1 4/2001 Jeffers
6,218,612 B1 4/2001 McKitrick
6,223,485 B1 5/2001 Beck
6,226,849 B1 5/2001 Beck
6,230,459 B1 5/2001 Jeffers
6,250,029 B1 6/2001 Jeffers et al.
6,253,509 B1 7/2001 Hellwig
6,276,103 B1 8/2001 Waalkes
6,279,278 B1 8/2001 Morris
6,282,854 B1 9/2001 Vos
6,286,275 B1 9/2001 Edwards
6,301,846 B1 10/2001 Waalkes
6,301,847 B1 10/2001 Beck
6,314,687 B1 11/2001 Schondelmayer
6,330,773 B1 12/2001 MacDonald
6,339,907 B1 1/2002 Dame
6,341,457 B1 1/2002 Aerts
6,351,917 B1 3/2002 MacDonald
6,393,783 B2 5/2002 Emaus
6,397,533 B1 6/2002 Hornberger
6,408,579 B1 6/2002 Anderson
6,415,567 B1 7/2002 Mead
6,442,909 B2 9/2002 Waalkes
6,481,168 B1 11/2002 Hodges
6,546,684 B2 4/2003 Waalkes
6,559,378 B1 5/2003 Bernard
6,612,077 B2 9/2003 Parshad
6,625,373 B1 9/2003 Wentworth
6,684,583 B2 2/2004 Hodges
6,684,929 B2 2/2004 MacDonald
6,729,085 B2 5/2004 Newhouse
6,735,908 B2 5/2004 Edwards
6,748,710 B2 6/2004 Gresham
6,756,539 B1 6/2004 VanderVelde
6,759,589 B1 7/2004 VanderVelde
6,763,169 B2 7/2004 Wentworth
6,807,776 B2 10/2004 Girdwood
6,820,388 B2 11/2004 Newhouse
6,910,306 B2 6/2005 Waalkes
6,915,056 B2 7/2005 Wentworth
6,944,993 B1 9/2005 Jilk
6,946,599 B2 9/2005 VanderVelde
6,951,085 B2 10/2005 Hodges
6,964,138 B2 11/2005 Carroll
6,972,368 B2 12/2005 VanderVelde
7,051,482 B2 5/2006 MacDonald
7,150,127 B2 12/2006 Underwood
7,208,676 B2 4/2007 VanderVelde
7,448,168 B2 11/2008 Waalkes
7,461,484 B2 12/2008 Battey
7,520,100 B1 4/2009 Herrman
2001/0013209 A1* 8/2001 Waalkes et al. ..... 52/239
2001/0037890 A1 11/2001 Ospina
2002/0189180 A1* 12/2002 King et al. ..... 52/243
2003/0182885 A1* 10/2003 Gresham et al. ..... 52/242
2003/0183349 A1 10/2003 Gresham
2004/0020137 A1 2/2004 Battey
2005/0144855 A1* 7/2005 Waalkes et al. ..... 52/36.1
2006/0236625 A1 10/2006 MacDonald
2007/0163190 A1 7/2007 Hofman
2007/0227079 A1 10/2007 Waalkes
2008/0104907 A1 5/2008 Glick
2008/0110112 A1 5/2008 Yu
2009/0090076 A1 4/2009 Abusada
2009/0094913 A1 4/2009 Singh

* cited by examiner

OFFICE PARTITION SYSTEM

SCOPE OF THE INVENTION

This invention relates to modular office partitions which can be joined together to form dividing wall structures.

BACKGROUND OF THE INVENTION

Office partitions are well known as being modular partitions which can be joined together to form dividing wall structures in an office environment. Office partitions are known which have removable covers and have capability for the passage of wiring including data cables and electrical wiring internally therethrough. Many previously known partitions suffer the disadvantage that they are expensive and provide complex structures.

SUMMARY OF THE INVENTION

To at least partially overcome these disadvantages of previously known partitions, the present invention provides a partition with a frame having two vertical end post members spanned by beam members with each end post member having an internally directed longitudinal slotway open towards the other end post member and within which the ends of the beam members are received and, preferably, with the end post members having a front to back width greater than the front to back width of the beam members such that vertical raceways are defined between the post members outward of the beam members and inward of removable cladding panels coupled to each front and back of the frame outward of the post members Preferably, channelways through each post member, preferably at the upper and/or lower ends of each post member, provide for access to the vertical raceways via horizontal raceways extending between the posts above and below each beam.

An object of the present invention is to provide a new construction for a partition which is lightweight and relatively inexpensive to manufacture yet provides for passage and laying in capability for wiring including data cable and electrical wiring.

Another object is to provide a novel post member adapted for ease of manufacture and easy coupling with beam members.

Accordingly, in one aspect, the present invention provides an upright partition for use in a modular office furniture system, the partition having a first end and a second end, the partition comprising a frame comprising two spaced elongate vertical post members and at least two vertically spaced elongate beam members with the post members joined by the beam members, the two post members comprising a first post member at the first end of the partition and a second post member at the second end of the partition, each of the two post members being elongate about a respective longitudinal, a vertical longitudinal center plane passing through the partition from the first post member to the second post member with the longitudinal of each post member lying in the center plane, each post member having as seen in cross-section normal its longitudinal, an end bight member, a front leg member and a rear leg member, with the front leg member and the rear leg member each extending away from the bight member forming a slotway therebetween about the center plane with the slotway of the first post member opening towards the second post member and the slotway of the second post member opening towards the first post member, each of the beam members having a first end and a second end, each of beam members spanning between the first post member and the second post member with the first end of each beam member received in the slotway of the first post member fixedly connected to the first post member in an overlapping moment resisting connection and the second end of each beam member received in the slotway of the second post member fixedly connected to the second post member in an overlapping moment resisting connection, the front leg member including a front face portion spaced from the center plane and presenting an outwardly directed front surface directed away from the center plane, the front leg member including a front return shoulder portion spaced from the bight member by the front face portion which front return shoulder portion extends from the front face portion towards the center plane to a forward inner plane where the front return shoulder portion supports an inwardly directed front flank surface lying in the forward inner plane directed toward the center plane, the forward inner plane being parallel to the center plane and between the center plane and the front face portion, the rear leg member including a rear face portion spaced from the center plane and presenting an outwardly directed rear surface directed away from the center plane, the rear leg member including a rear return shoulder portion spaced from the bight member by the rear face portion which rear return shoulder portion extends from the rear face portion towards the center plane to a rearward inner plane where the rear return shoulder portion supports an inwardly directed rear flank surface lying in the rear inner plane directed toward the center plane, the rearward inner plane being parallel to the center plane and between the center plane and the rear face portion, each beam member having a front outward face and a rear outward face spaced apart the same distance as the forward inner plane and the rearward inner plane, the first end of each beam member located the slotway in the first post member between the front leg member and the rear leg member with the front outward face of the beam member secured to the front flank surface of the first post member, and the rear outward face of the beam member secured to the rear flank surface of the first post member, and the second end of each beam member located the slotway in the second post member between the front leg member and the rear leg member with the front outward face of the beam member secured to the front flank surface of the second post member, and the rear outward face of the beam member secured to the rear flank surface of the second post member.

In another aspect, the present invention provides an upright partition for use in a modular office furniture system, the partition having a first end and a second end, the partition comprising a frame comprising two spaced elongate vertical post members and at least two vertically spaced elongate beam members with the post members joined by the beam members, the beam members comprising at least an upper most beam member and a lowermost beam member, the two post members comprising a first post member at the first end of the partition and a second post member at the second end of the partition, each of the two post members being elongate about a respective longitudinal, a vertical longitudinal center plane passing through the partition from the first post member to the second post member with the longitudinal of each post member lying in the longitudinal center plane, each post having as seen in cross-section normal its longitudinal, an end bight member, a front leg member and a rear leg member, with the front leg member and the rear leg member each extending away from the bight member forming a slotway therebetween about the center plane with the slotway of the first post member opening towards the second post member and the slotway of the second post member opening towards the first post member, each of the beam members having a first end and a second end, each of beam members spanning between the first post member and the second post member with the first end of each beam member fixedly connected to the first post member in an overlapping moment resisting connection and the second end of each beam member fixedly connected to the second post member in an overlapping moment resisting connection, the first end of the uppermost beam member received in the slotway of the first post member, the second end of the uppermost beam member received in the slotway of the second post member, the front leg member including a front face portion spaced from the center plane and presenting an outwardly directed front surface directed away from the center plane, the front leg member including a front return shoulder portion spaced from the bight member by the front face portion which front return shoulder portion extends from the front face portion towards the center plane to a forward inner plane where the front return shoulder portion supports an inwardly directed front flank surface lying in the forward inner plane directed toward the center plane, the forward inner plane being parallel to the center plane and between the center plane and the front face portion, the rear leg member including a rear face portion spaced from the center plane and presenting an outwardly directed rear surface directed away from the center plane, the rear leg member including a rear return shoulder portion spaced from the bight member by the rear face portion which rear return shoulder portion extends from the rear face portion towards the center plane to a rearward inner plane where the rear return shoulder portion supports an inwardly directed rear flank surface lying in the rear inner plane directed toward the center plane, the rearward inner plane being parallel to the central plane and between the center plane and the rear face portion, the uppermost beam member having a front outward face and a rear outward face spaced apart the same distance as the forward inner plane and the rearward inner plane, the first end of the uppermost beam member located the slotway in the first post member between the front leg member and the rear leg member with the front outward face of the uppermost beam member secured to the front flank surface of the first post member, and the rear outward face of the uppermost beam member secured to the rear flank surface of the first post member, and the second end of the uppermost beam member located the slotway in the second post member between the front leg member and the rear leg member with the front outward face of the uppermost beam member secured to the front flank surface of the second post member, and the rear outward face of the uppermost beam member secured at least to the rear flank surface of the second post member.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
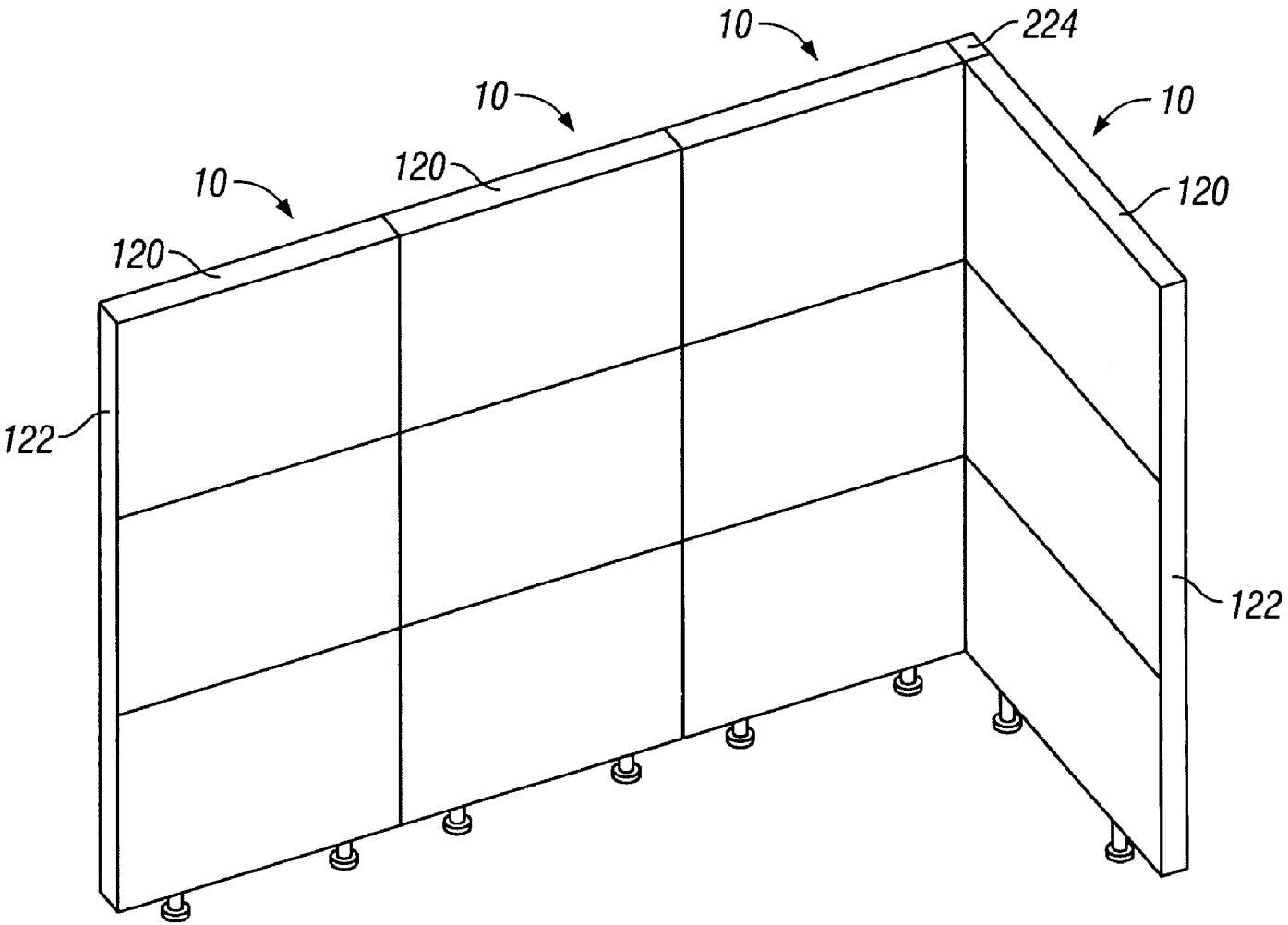
FIG. 1 is a pictorial view of a wall structure formed from four partitions in accordance with a first embodiment of the present invention.

Reference is made first to FIG. 1 which shows four modular partitions 10 in accordance with the present invention arranged to form a dividing wall structure as can be useful in an office environment. Three of the partitions 10 are shown joined end to end in line and a fourth partition is joined to extend at a right angle to the other partitions.

Frame

Figure 2:
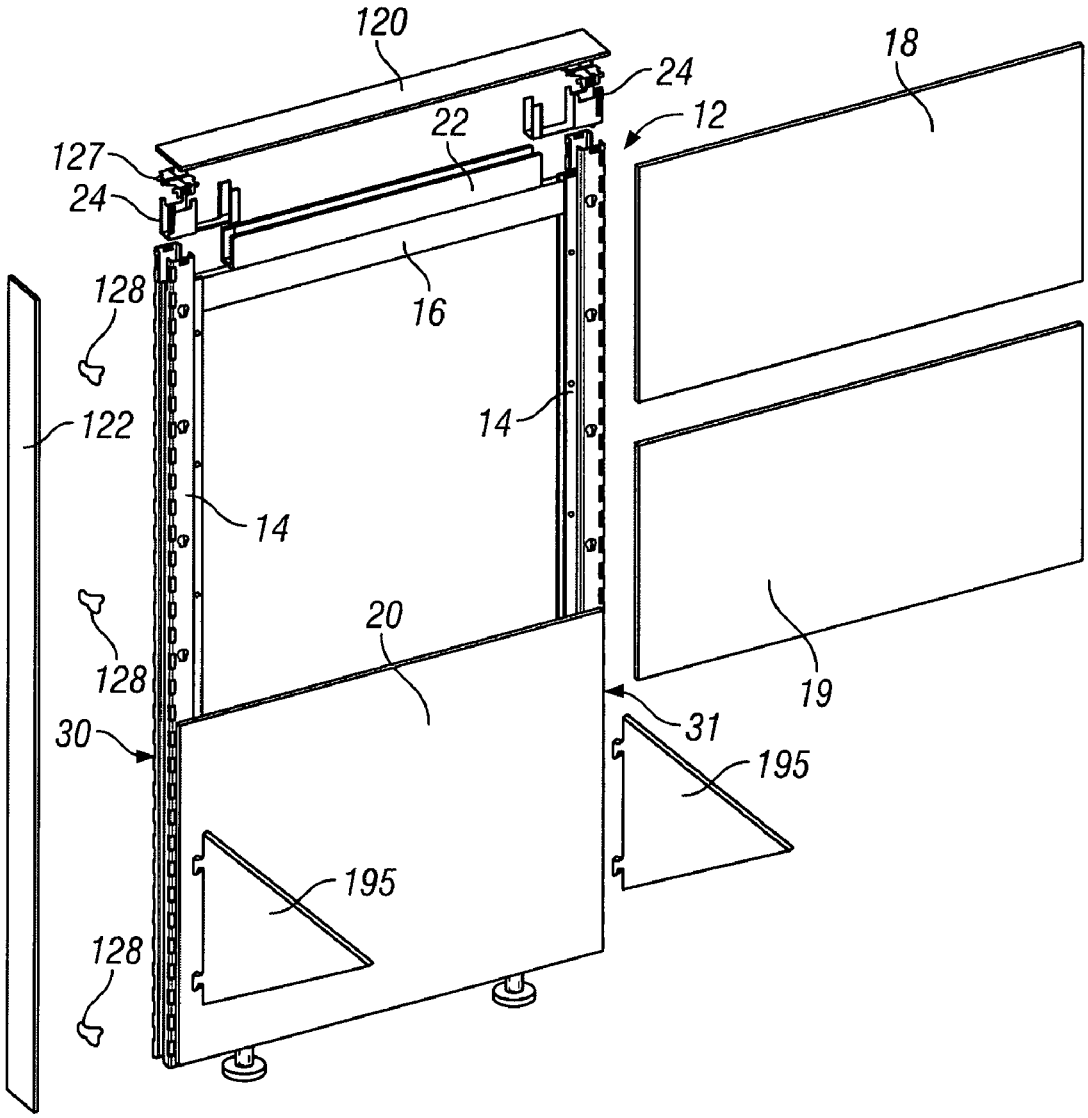
FIG. 2 is a schematic, partially exploded view of one partition shown in FIG. 1 and including a pair of removable depending brackets.

Reference is made to FIG. 2 which in a schematic partially exploded view illustrates the left-handmost partition 10 in FIG. 1. As seen in FIG. 2, principal elements of the partition 10 include a frame 12 formed by vertical post members 14 and horizontal beam members 16. Removable cladding panels are provided preferably on both sides of the frame 12 and FIG. 2 shows an upper cladding panel 18 and a middle cladding panel 19 in exploded view uncoupled from the frame. A lower cladding panel 20 is shown as coupled to the frame. For ease of convenience, corresponding cladding panels to be provided on the rear of the partition are not shown. A channel member 22 is secured to the uppermost beam member 16 to assist in retaining wires which may pass through upwardly opening slots at each upper end of the post members 14. Two grommet members 24 are provided in the slots in the upper ends of the post members. Decorative trim members include a top cap 120 to be secured to each post member 14 via post clips 127 and an end cap 122 to be secured to one post member by end clips 128. The partition 10 has a first end 30 and a second end 31.

Figure 3:
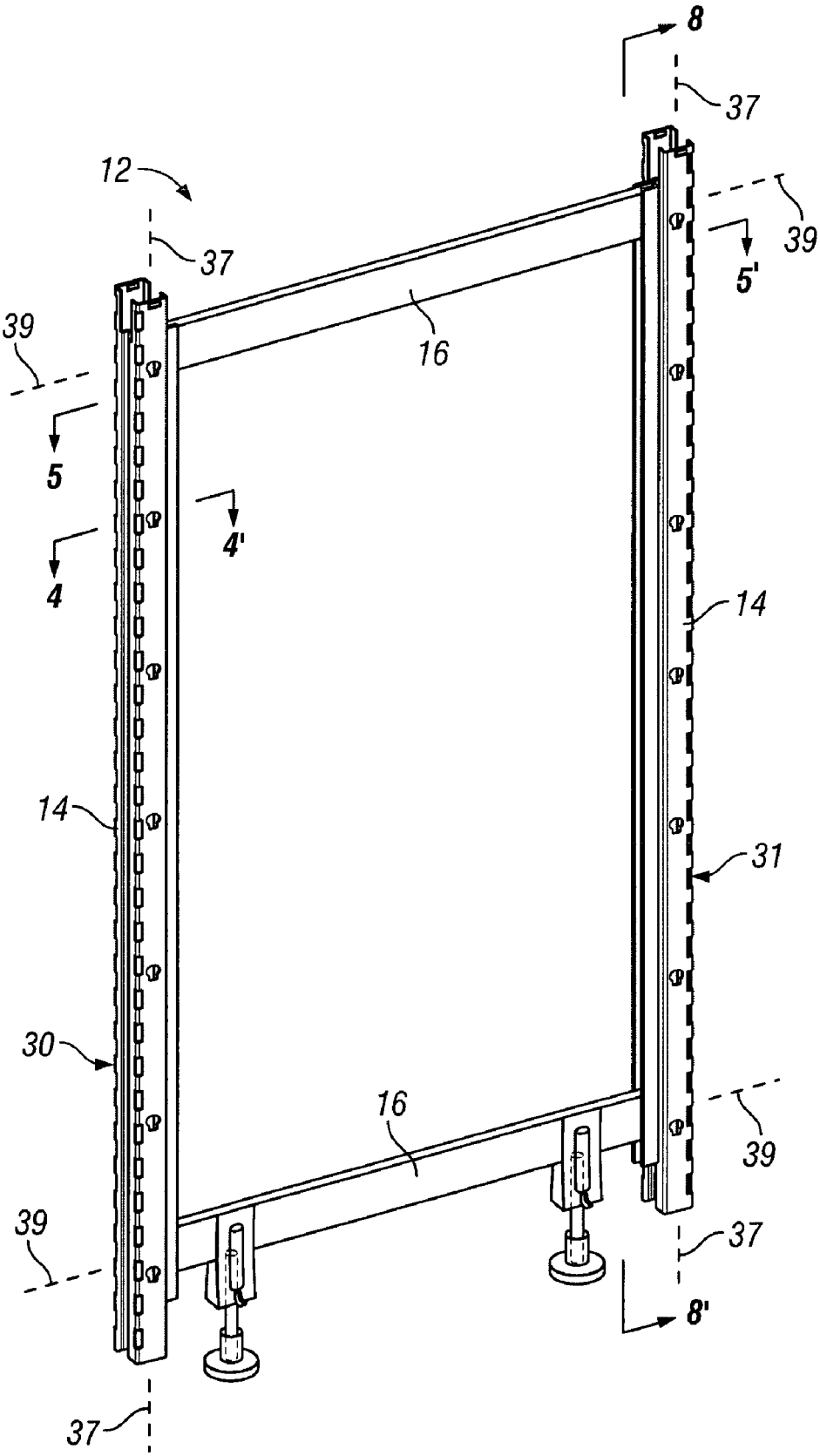
FIG. 3 is a pictorial view of the frame of the partition shown in FIG. 2.

Reference is made to FIG. 3 which shows the frame 12 comprising two spaced elongate vertical post members 14 and two vertically spaced elongate beam members 16 which span across and join the post members 14. As seen in FIGS. 2 and 3, the first of the post members is at the first end 30 of the partition and the second post member is at the second end 31 of the partition.

Figure 4:
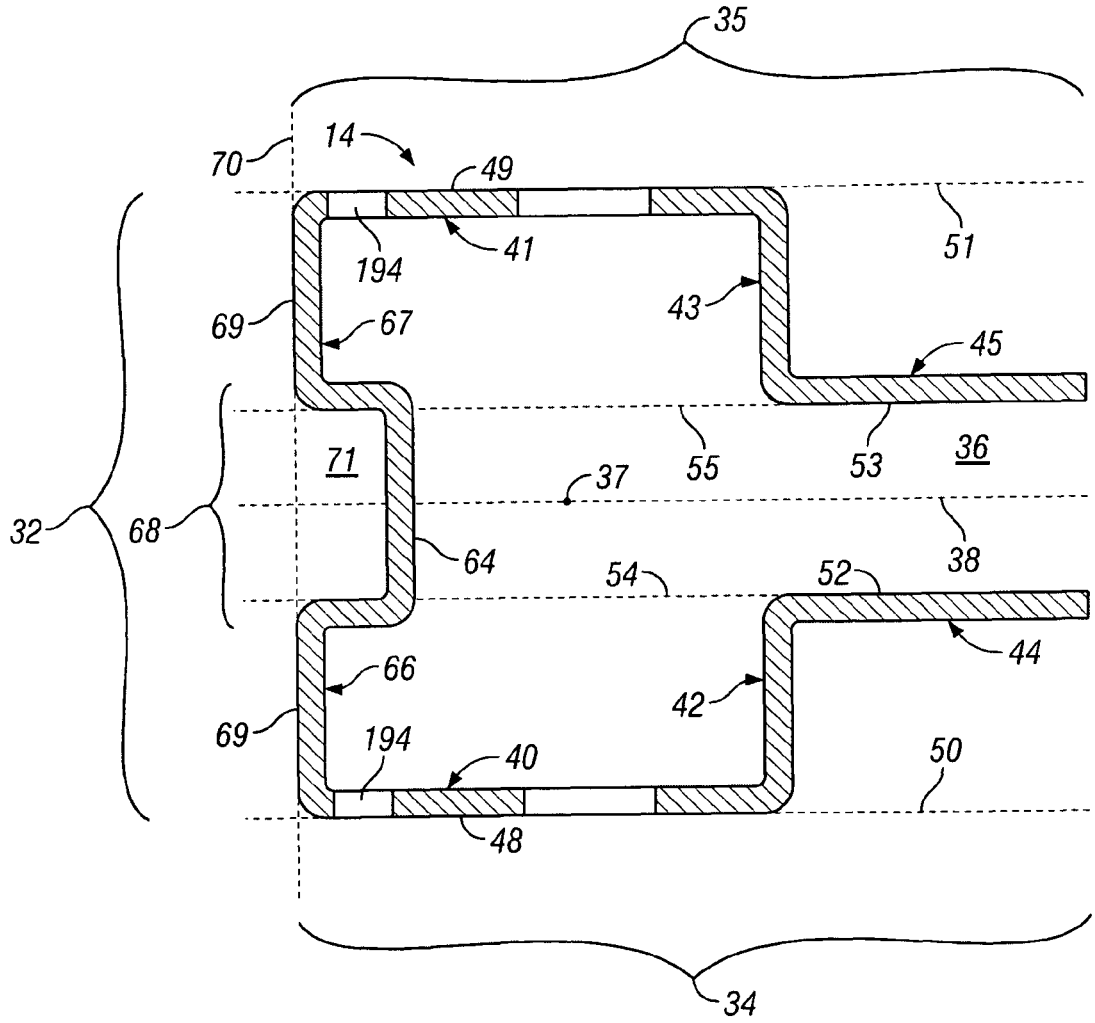
FIG. 4 is a cross-sectional view of one post member taken along section line 4-4' in FIG. 3.

Reference is made to FIG. 4 which shows a horizontal cross-section through one of the post members 14 along section line 4-4' in FIG. 3. As seen in FIG. 4, the post member has a roughly U-shape as seen in cross-section. The post member 14 can be characterized as comprising three members, namely an end bight member 32, a front leg member 34 and a rear leg member 35. Each of the front leg member 34 and the rear leg member 35 extend away from the bight member 32 forming a slotway 36. In assembled frame 12, the slotway 36 of a first post member opens towards the second post member and the slotway 36 of a second post member opens towards the first post member.

Figure 5:
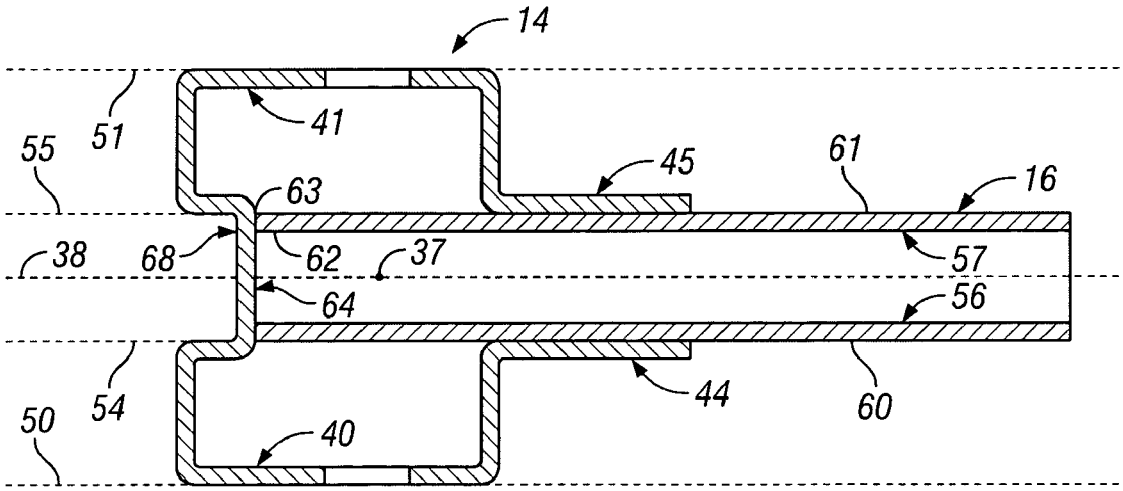
FIG. 5 is a cross-sectional view showing the connection of a post member and a beam member as taken along section line 5-5' in FIG. 3.

As seen in FIG. 3, each post member 14 is elongate about a respective longitudinal 37 indicated schematically in FIGS. 3, 4 and 5. A longitudinal center plane 38 is defined as passing through the partition 10 and its frame 12 from a first post member 14 to the second post member 14 such that the longitudinal 37 of each post member lies in this center plane 38 indicated in the dashed lines in FIGS. 4 to 8. The front leg member 34 includes a front face portion 40, a front return shoulder portion 42 and a front flank portion 44. The front face portion 40 extends from the bight member 32 to merge into the front return shoulder portion 42 which subsequently merges into the front flank portion 44. The front face portion 40 provides a front surface 48 directed outwardly away from the center plane 38. The front surface 48 lies in a forward outer plane 50 indicated in the dashed lines which is parallel to the center plane 38 spaced outwardly therefrom. The front return shoulder portion 42 is spaced from the bight member 32 by the front face portion 40. The front return shoulder portion 42 extends from the front face portion 40 inwardly towards the center plane 38 to a forward inner plane 54. The front return shoulder portion 42 supports a front flank surface 52 on the front flank portion 44. The front flank surface 52 is inwardly directed towards the center plane and lies in the forward inner plane 54. The forward inner plane 54 is parallel to the center plane 38 and located between the center plane 38 and the forward outer plane 50 spaced from each.

The rear leg member 35 is a mirror image of the front leg member 34 about the center plane 38. In this regard, similarly the rear leg member 35 includes a rear face portion 41, a rear return shoulder portion 43 and a rear flank portion 45. The rear face portion 41 extends from the bight member 32 to merge into the rear return shoulder portion 43 which subsequently merges into the rear flank portion 45. The rear face portion 41 provides a rear surface 49 directed outwardly away from the center plane 38. The rear surface 49 lies in a rearward outer plane 51 indicated in the dashed lines which is parallel to the center plane 38 spaced outwardly therefrom. The rear return shoulder portion 43 is spaced from the bight member 32 by the rear face portion 41. The rear return shoulder portion 43 extends from the rear face portion 41 inwardly towards the center plane 38 to a rearward inner plane 55. The rear return shoulder portion 43 supports a rear flank surface 53 on the rear flank portion 45. The rear flank surface 53 is inwardly directed towards the center plane and lies in the rearward inner plane 55. The rearward inner plane 55 is parallel to the center plane 38 and located between the center plane 38 and the rearward outer plane 51 spaced from each Each post member 14 is preferably formed from a sheet of metal which is bent and deformed so as to assume the desired shape as shown in FIG. 4.

Figure 8:
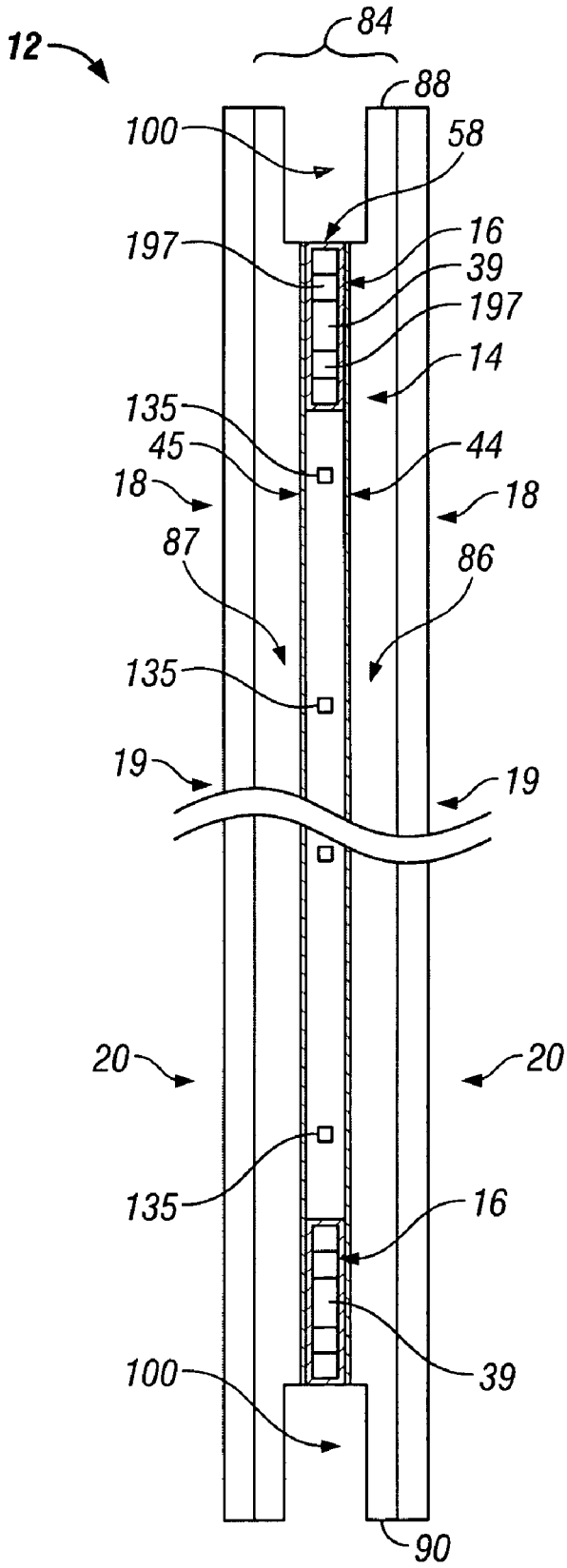
FIG. 8 is a vertical cross-sectional view of the frame shown in FIG. 3 along vertical section line 8-8'.
Figure 13:
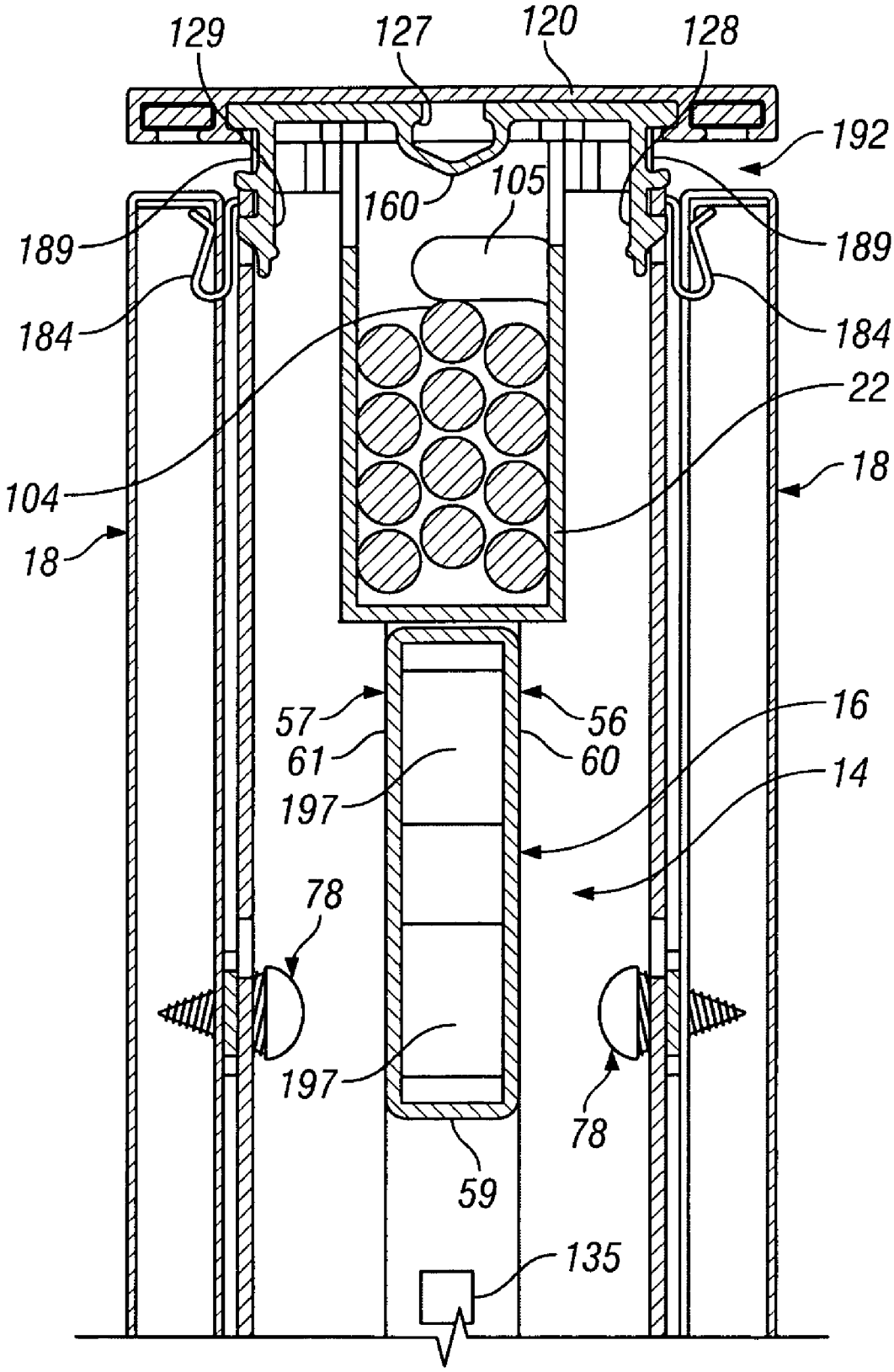
FIG. 13 is a vertical cross-sectional view along section line 13-13' in FIG. 12 with the top cap attached.

Each beam member 16 is an elongate member having a first end and a second end with the beam member disposed about a beam longitudinal 39 as best seen in FIG. 8 and FIG. 13 in end view, that is, in cross-section normal to its longitudinal 39. As seen in FIG. 13, each beam member 16 is a hollow rectangular tubular member with a front 56, a rear 57, a top 58 and a bottom 59. The front 56 presents a forwardly directed front outward face 60 and the rear 57 presents a rearwardly directed rear outward face 61. The beam members 16 span between the post members 14 with the longitudinal 39 of each beam member lying in the center plane 38. Each of the beam members 16 spans between the two post members 14 with a first end of each beam member 16 received in the slotway 36 of a first post member 14 and is fixedly connected therein in an overlapping moment resisting connection. Similarly, the second end of each beam member 16 is received in the slotway 36 of a second post member 14 fixedly connected to the second post member 14 in an overlapping moment resisting connection. In this regard, each end of each beam member 16 is located in the slotway 36 of a post member 14 as seen, for example, in FIG. 5. Each beam member 16 has its front outward face 60 and its rear outward face 61 disposed parallel to the longitudinal of the beam member 16 and spaced apart the same distance that the forward inner plane 54 and the rear inner plane 55 of the post member 14 are spaced. With each beam member 16 located in the slotway 36 between the front leg member 34 and the rear leg member 35, the front outward face 60 of the front 56 of beam member 16 is secured to the front flank surface 52 of the front flank portion 44 of the post member 14. Similarly, the rear outward face 61 of the rear 57 of the beam member 16 is secured to the rear flank surface 53 of the rear flank portion 45 of the post member 14. As may be seen in FIG. 5, each end 62 of the beam member 16 preferably provides an end face 63 which engages and is in abutment with an inner bight surface 64 of the bight member 32.

In the preferred embodiment, the beam member 16 is formed from metal compatible for welding to the post member 14. The beam members 16 and post members 14 are welded together over a juncture between the front outer face 60 of the beam member 16 and the front flank surface 52 of the post member 14, over the rear outward face 61 of the beam member 16 and the rear flank surface 53 of the post member 14 and between the end face 63 of the beam member 16 and the inner bight surface 64 of the post member 14. Welding is a preferred method of connection to provide a moment resisting connection between the overlapping post member and beam member, however, other connection mechanisms may be used including, for example, fasteners.

As seen in FIGS. 4 and 5, in the preferred embodiment, the bight member 32 is shown to comprise a front portion 66, a rear portion 67 and a U-shaped channel portion 68 therebetween. The front portion 66 and the rear portion 67 each carry an end surface 69 directed towards the end of the partition 10 and disposed in an end plane 70 normal to the center plane 38. The U-shaped channel portion 68 extends inwardly from the end plane 70 and defines a vertically extending end channel 71 in the end of the post member 14. In preferred in line end to end coupling of adjacent identical partitions 10 as seen in FIG. 1, the end surfaces 69 of adjacent partitions 10 abut, with the partitions 10 drawn together as with fasteners such as bolts with nuts.

As seen in FIG. 5, the slotway 36 has an inner blind end formed by the inner bight surface 64 of the bight member 32 with the end 62 of the beam secured to the bight member 32 at the blind end of the slotway 36.

Figure 7:
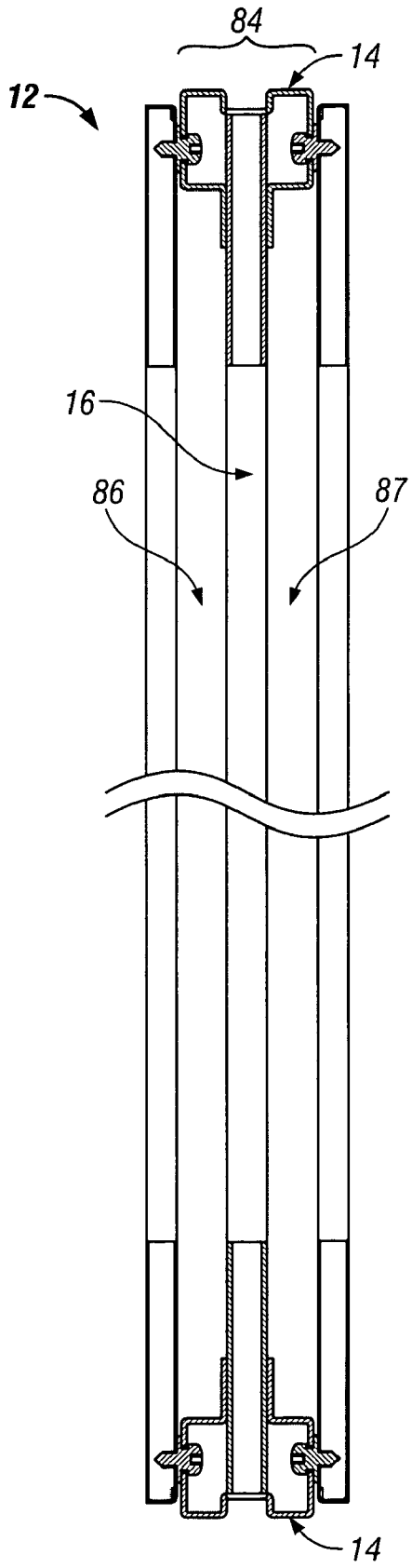
FIG. 7 is a schematic cross-sectional top view of the frame of FIG. 3 along section line 5-5' in FIG. 3.

In an assembled frame as seen, for example, in FIGS. 2, 7 and 8, both the post longitudinals 37 and the beam longitudinals 39 lie in the center plane 38.

Cladding Panels

Figure 9:
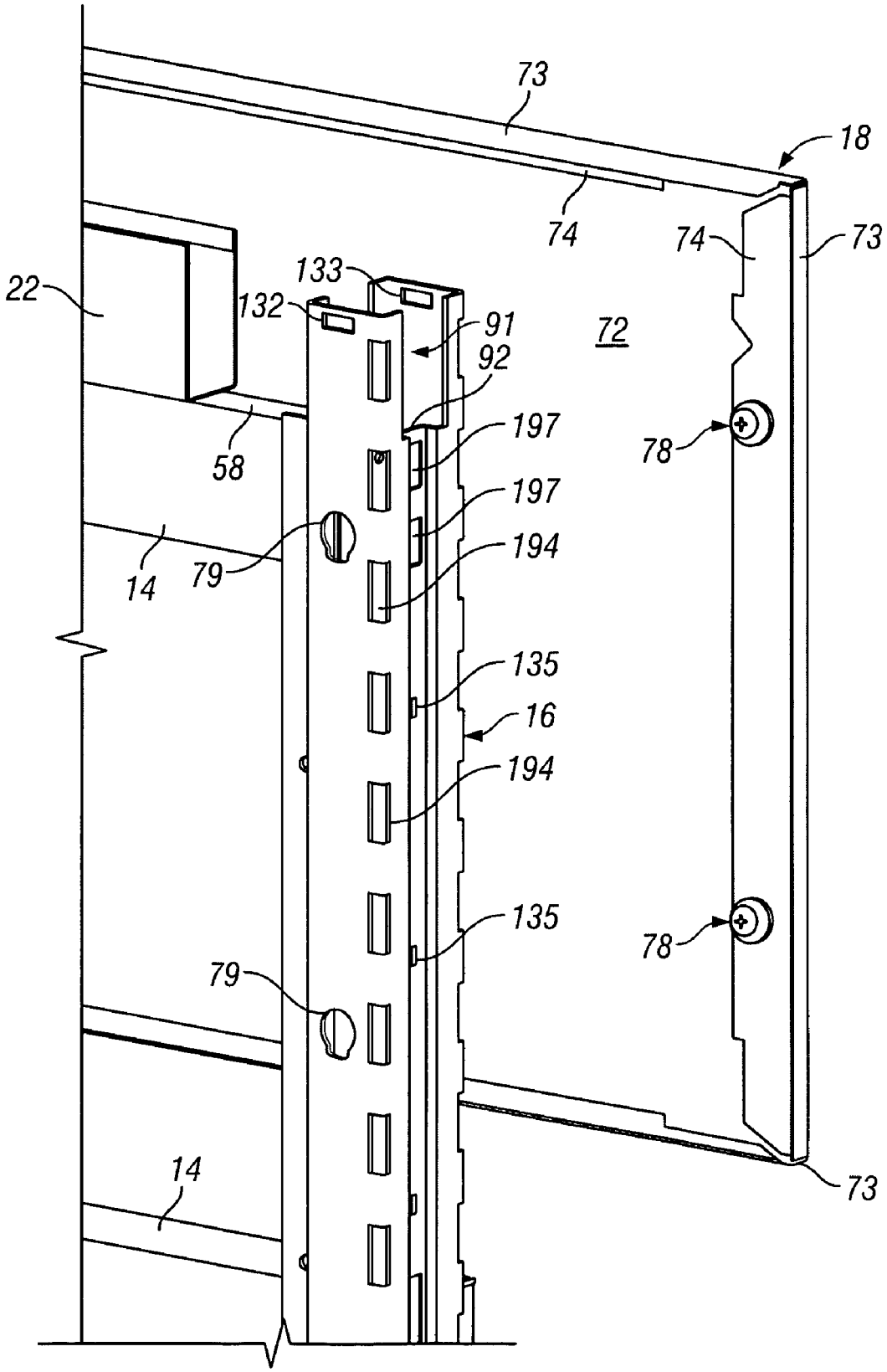
FIG. 9 is a partial pictorial view of an upper left corner of the frame as shown in FIG. 3 as seen from the rear with a channel member coupled thereto and an upper cladding panel positioned ready for coupling to the frame.

Reference is made to FIG. 9 showing in a pictorial exploded rear view the uppermost left corner of a partition 10 shown in FIG. 3 showing the assembled frame 12 with part of one post member 14 and part of an uppermost beam member 16. A front upper cladding panel 18 is shown in rear perspective view as having a construction preferably common to each of the cladding panels 18, 19 and 20. As shown, the cladding panel 18 is preferably formed from a thin sheet of metal so as to provide a substantially planar rectangular main face 72 and on each of its edges, an edge portion 73 which extends inwardly from the main face 72 perpendicular thereto which edge portion 73 merges into a return flange 74 extending normal to the edge portion 73 inward of the main face 72.

Figure 6:
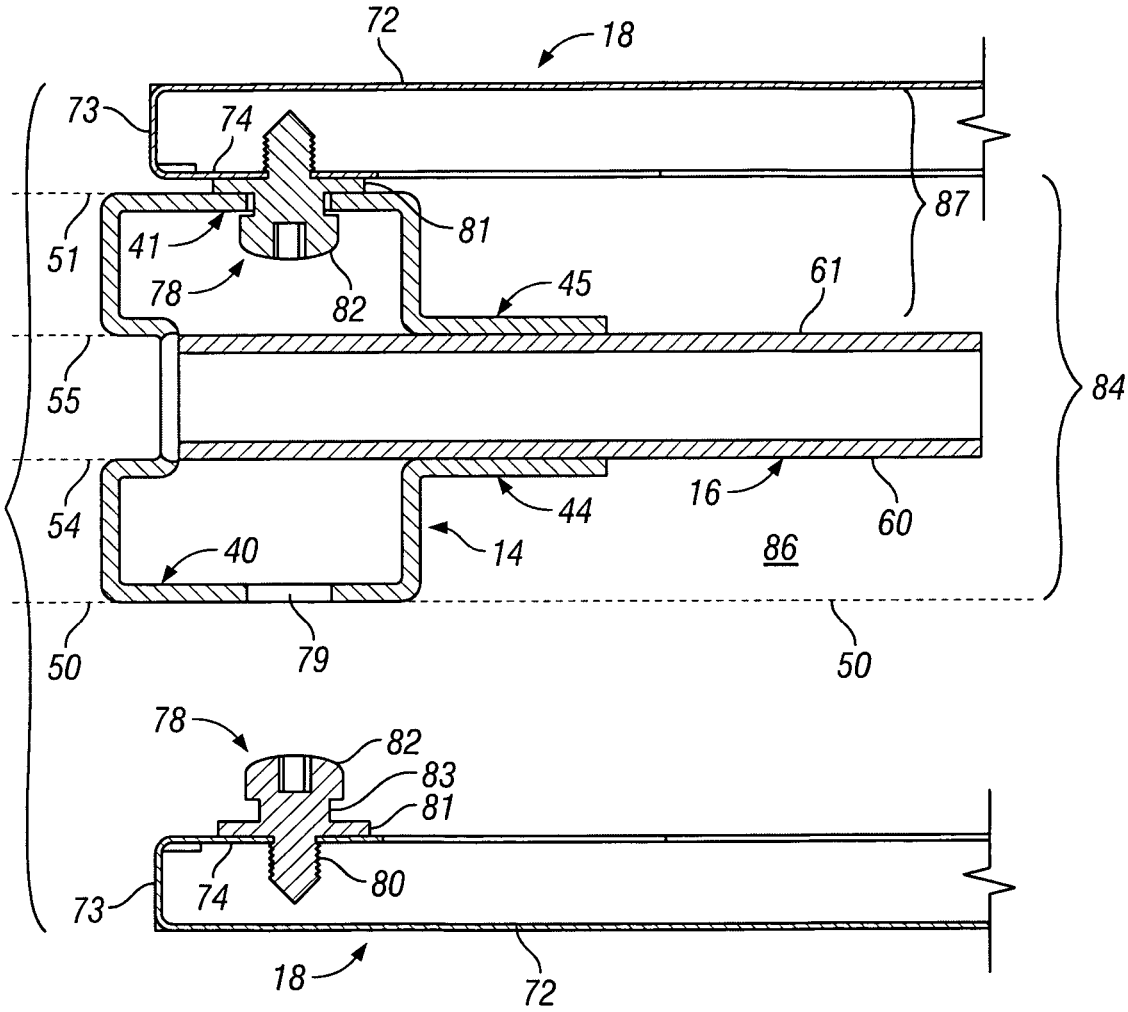
FIG. 6 is a cross-sectional side view as shown in FIG. 5, however, with one cladding panel shown coupled to the frame and another cladding panel shown positioned ready for coupling to the frame.

As seen in FIG. 9, the vertically extending return flange 74 carries a pair of hook members 78 adapted to be received in complementary keyhole slots 79 provided in the front face portion 40 of the post member 14. In FIG. 9, similar keyhole slots 79 are shown on the rear face portion 41. As seen in FIG. 6, each hook member 78 has a threaded shank 80 by which the hook member is fixedly secured through an opening in the return flange 74. The hook member 79 has a washer portion 81 and a distal head portion 82 with an annular slot 83 between. The head portion 82 is sized to pass horizontally through a larger width uppermost portion of the keyhole slot 79. When the cladding panel 18 is moved vertically downwardly, a lesser width lowermost portion of the keyway slot 79 can become received within the annular slot 83 securing the cladding panel 18, but for removal by lifting the cladding panel 18 vertically upwardly so as align the head portion 82 with the larger width uppermost portion of the keyway slot 79 permitting removal of the cladding panel 18 by movement horizontally. FIG. 6 illustrates one cladding panel 18 as coupled via its hook member 78 into the keyhole slot 79 and another cladding panel 18 disposed outwardly from the post member 14 with its hook member 78 aligned with the keyhole slot 79 for coupling thereto.

Reference is made to FIGS. 7 and 8 which show cross-sectional top and vertical cross-sections through a frame 12 with the cladding panels 18, 19 and 20 coupled to the frame. In this regard, as seen in FIG. 6, the return flange 74 on each cladding panel closely overlies the front face portion 40 or the rear face portion 41 of each post member 14 when a cladding panel is coupled to the frame 12.

In a preferred embodiment, as shown, each cladding panel 18, 19 and 20 is coupled to the frame 12 by engagement with the post member 14. This is preferred but not necessary and it is possible to configure different arrangements for coupling of the cladding panels to the beam members 16.

In the preferred embodiment, as seen in FIGS. 7 and 8, with the cladding panels 18 coupled to the frame 12, an interior cavity 84 is defined between the two post members 14 and the inner faces of the front cladding panels and the inner faces of the rear cladding panels. In the preferred embodiment, this interior cavity is defined: between the two post members 14 and, at least between the front face portion 40 and the rear face portion 41 since the inner face of each of the front cladding panels and the rear cladding panels are disposed outwardly of the front face portion 40 or the rear face portion 41. The interior cavity 84 may also be seen as defined at least between the forward outer plane 50 and the rearward outer plane 51. However, with the main face 72 of each cladding panel disposed outwardly from the forward outer plane 50 or the rearward outer plane 51, the interior cavity extends outwardly to the inner face of the cladding panels at least between the post members.

A vertically extending front raceway 86 is defined within the internal cavity 84 outward of the front outward face 60 of the beam members 16 and inward of the inner face of each front cladding panel, which is at least inward of the forward outer plane 50. The front raceway 86 may also be seen as defined at least between the forward outer plane 50 and the forward inner plane 54. Similarly, a vertically extending rear raceway 87 is defined within the internal cavity 84 outward of the rear outward face 61 of the beam members 16 and inward of the inner face of each rear cladding panel, which is at least inward of the rearward outer plane 51. The rear raceway 87 may also be seen as defined between the rearward outer plane 51 and the rearward inner plane 55. Each of the vertically extending front raceway 86 and the vertically extending rear raceway 87 provides for passage of wiring throughout the entire height of the frame 12 between the post members 14.

Each of the post members 14 has an upper end 88 and a lower end 90. An exterior top slot 91 is provided in the bight member 32 at the upper end 88 of the post member 14 extending from the upper end 88 of the post member downwardly to a blind lower end 92 may be seen, for example, in FIG. 8 and FIG. 9. The top slot 91 is preferably symmetrically disposed about the center plane 38. The blind lower end 92 of the top slot 91 is preferably disposed at the same height as the top 58 of the uppermost beam member 16. As may be seen in FIG. 11, the post member 14 at its upper end 88 has the front flank portion 44 and the rear flank portion 45 removed above the top 58 of the uppermost beam member 16. As well, portions of the front return shoulder portion 42 and the rear return shoulder portion 43 have been removed above the beam member 16 so as to provide the slotway 36 enlarged as an interior top slot 93 above the beam member between the front leg portion 34 and the rear leg portion 35 of comparable width front to back as the exterior top slot 91.

At the upper end 88 of the post member 14, the exterior top slot 91 together with the slotway 36 between the front leg member 34 and the rear leg member 35 define a channelway 100 horizontally through the post member 14 open upwardly to the upper end 88 of the post member.

The channelway 100 through the post member 14 together with the interior cavity 84 above the uppermost beam member 16, below the upper end 88 of the post member 14 and between the inner faces of the front and rear cladding panels define a horizontal upper raceway 102 open upwardly which permits laying in of wiring from above the post members 14 horizontally from beyond the end surface 69 of one of the post members across the partition 10 to beyond the end surface 69 of the other post member.

Figure 12:
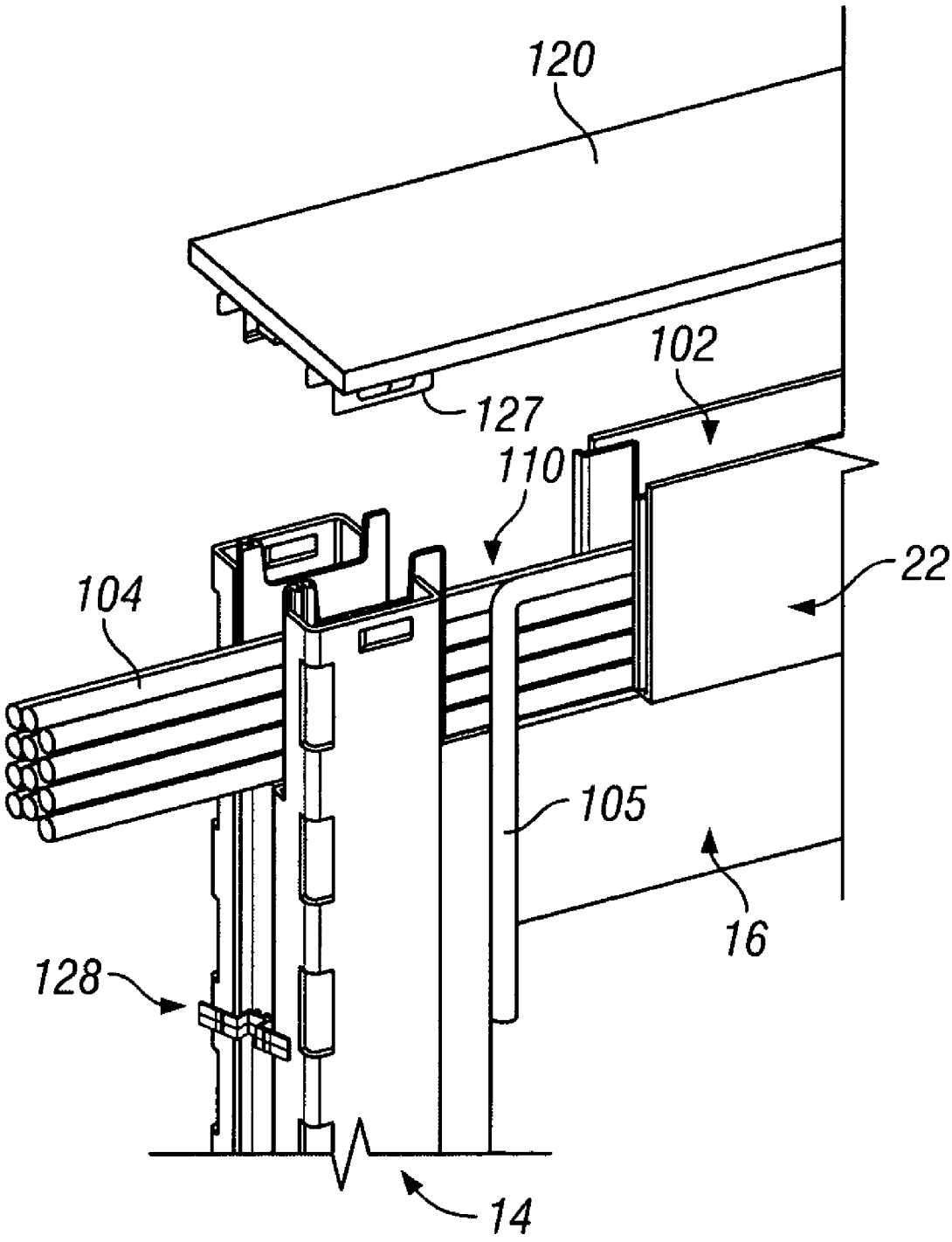
FIG. 12 is an exploded pictorial view similar to FIG. 10 but also showing the wiring passing through the partition and an end clip.

Reference is made to FIGS. 12 and 13 which show a preferred manner of passing wiring through the partition 10.

Figure 14:
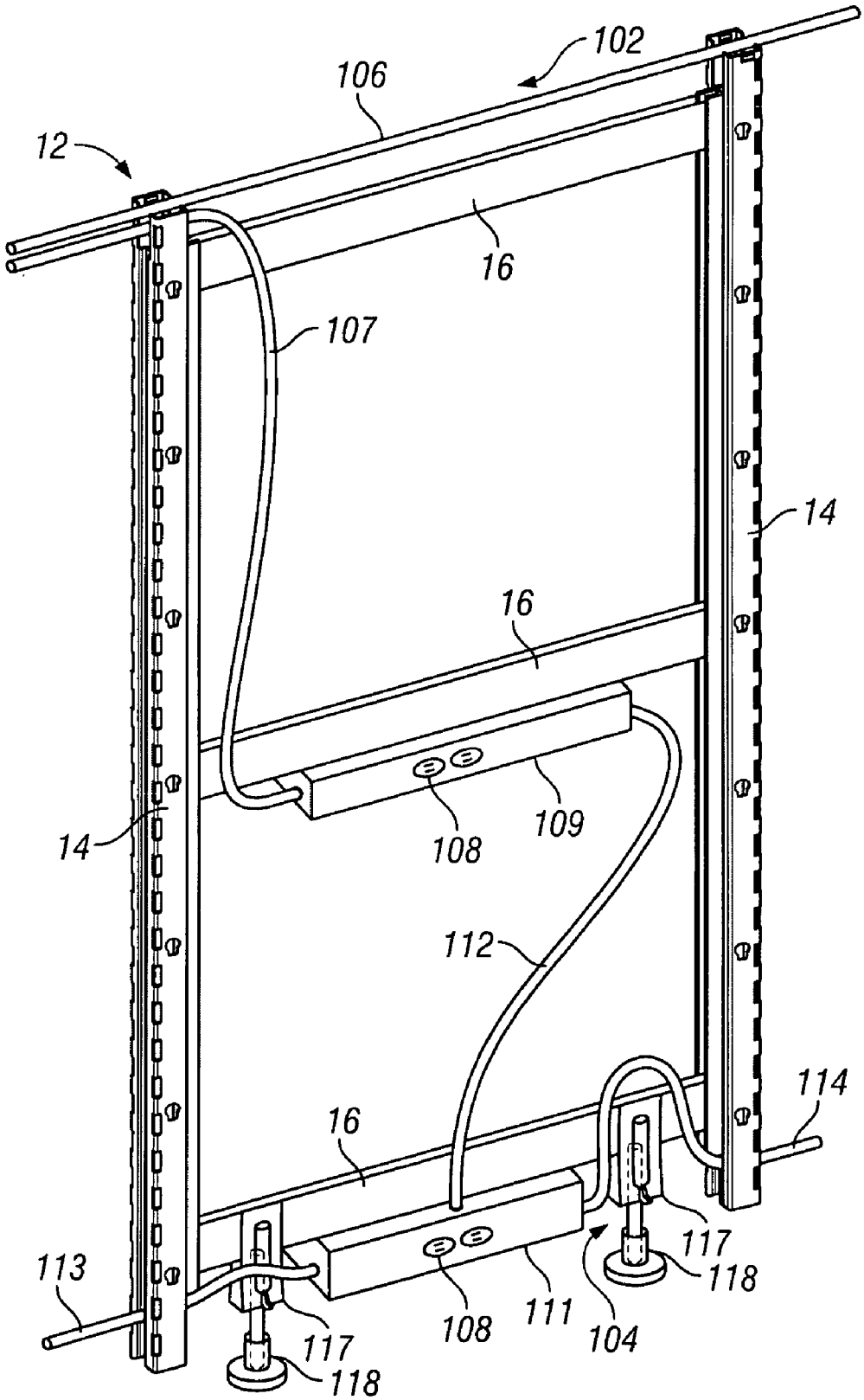
FIG. 14 is a pictorial front view of the frame as shown in FIG. 3 but modified to show electrical outlets and wiring.

A plurality of wiring, as seen in FIG. 12, include some wires 104 which extend horizontally across the top of the partition 10 from beyond the end of one post member to beyond the end of the other post member as, for example, to pass from one partition to a connected partition or other structure. A similar such wire 106 is also shown in FIG. 14. In this regard, the wire 104 extends horizontally through the upper raceway 102. The upper raceway 102 is open upwardly from above to permit laying in of wiring from above the post members 14. As seen in FIGS. 12 and 13, one wire 105 extends from the upper raceway 102 down through the gap 101 between the post member 14 and the channel member 22 and vertically past the uppermost beam 16 within the vertical front raceway 86, that is, inward of the upper cladding panel 18 shown in FIG. 13.

Reference is made to FIG. 14 which illustrates a similar arrangement without the channel member 22 or the grommet members 24 and in which one wire 106 extends horizontally across the width of the partition 10 within the upper raceway and another wire 107 extends from the upper raceway vertically downwardly outside of the beam member 16.

Each frame 12 preferably has at least two beam members 16, however, additional beam members 16 may be provided. FIG. 14 illustrates an embodiment in which a third intermediate beam member 16 is provided. FIG. 14 also shows an arrangement with utility outlets 108 provided on a waist-high module 109 supported on an intermediate beam member 16 and utility outlets 108 provided on a baseline module 111 supported on a lowermost beam member 16. These modules 109 and 111 are shown as being interconnected by wirings 112 which extend internally passing vertically of the beam members 16 in the vertically extending front raceway. As seen in FIG. 8, the lower end 90 of each post member also carries a channelway 100 substantially the same as the channelway 100 at the upper end 88 of each post member. A lower horizontal raceway 103 is provided horizontally across the partition which is open downwardly to permit ease of laying up of wiring into this lower raceway 116 to permit passage of wiring throughout the entire width of the partition 10 and beyond.

As seen in FIGS. 3 and 14, two legs support brackets 117 are fixedly secured to each of the lowest-most beam members 16. Height adjustable support legs 118 are threadably coupled to the foot support brackets with the support legs 118 to contact a floor surface and permit levelling and height adjustment of the partition 10. The foot support brackets 117 and the support legs 118 preferably do not impede passage of wiring 113 and 114 through the lower horizontal raceway, however, if they do, then the wiring may be moved upwardly past the beam member 16 over the brackets 117 and then downwardly past the brackets 117 in a manner as shown on the right-hand side of FIG. 14. The various wires indicated as 104, 105, 106, 107, 112, 113 and 114 may be selected from wiring including communication wiring such as for telephone, computer, the Internet and the like and electrical power wiring and optical cables.

Spacing the foot support brackets 117 on the beam members 16 inwardly from the post members 14 assists in permitting wiring 113 and 114 to be passed through the channelways 100 at the lower end 90 of each post member.

The upper raceway 102 between the post members 14 overlaps with the front raceway 86 and the rear raceway 87. Similarly, the lower horizontal raceway 103 between the post members 14 overlaps with the front raceway 86 and lower raceway 87. Communication can thus be provided internally of each partition 10 between the post members 14 and inside the cladding panels as via the front raceway 86 and the rear raceway 87. In addition, communication can be provided from the interior of each partition 10 through the post members 14 via the channelway 100 through the post members at each of the upper and lower ends of the post members.

Trim Arrangement

As seen in FIG. 1, on the exposed upper edge and ends of the partition, there are provided decorative members comprising a top cap 120, an end cap 122 and a corner cap 124.

A preferred arrangement for coupling these trim members is illustrated in FIGS. 19 to 28.

Figure 19:
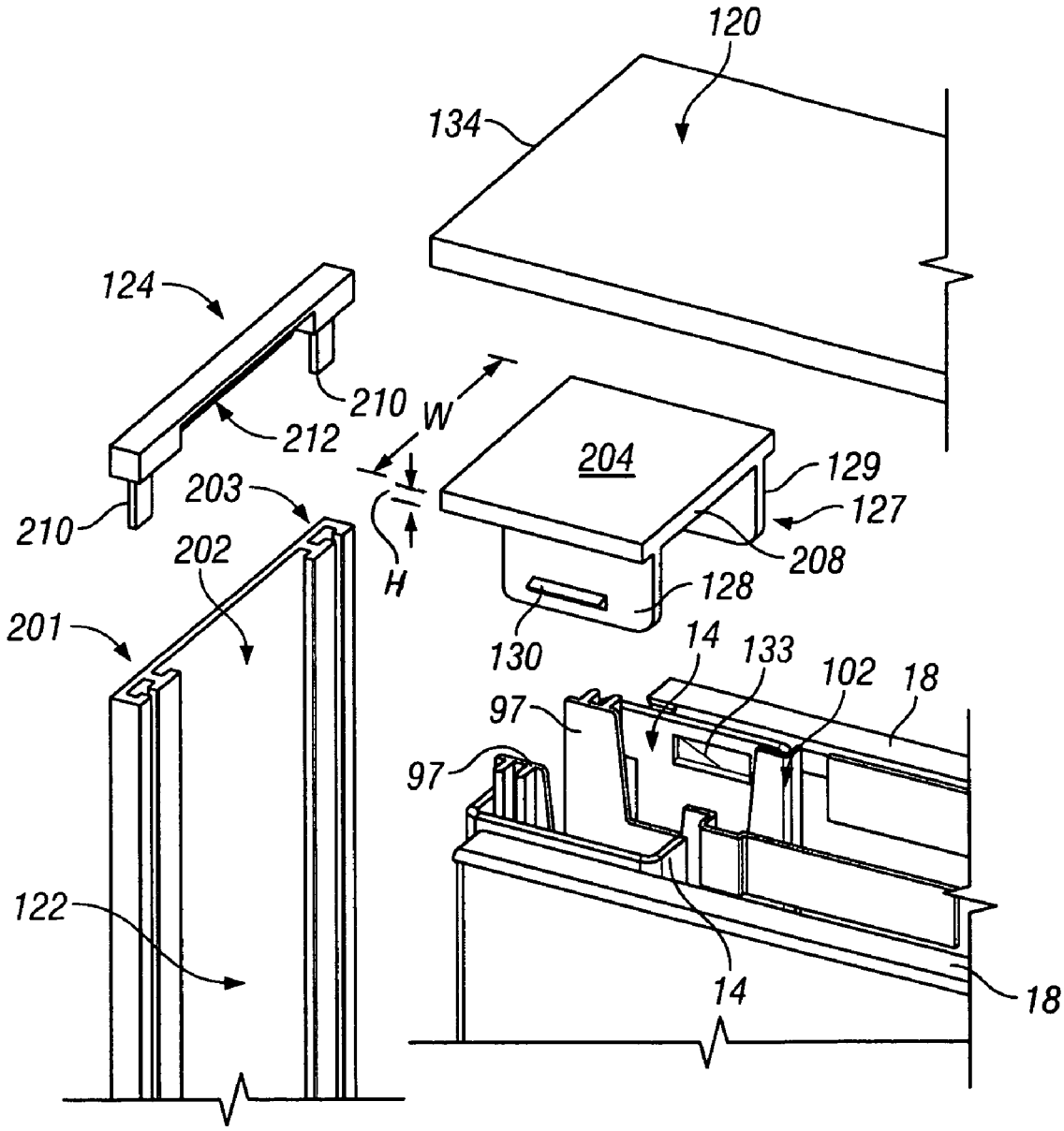
FIG. 19 is an exploded pictorial view of an upper left-hand corner of a partition showing a preferred arrangement for attaching trim member at an end of line partition.

FIG. 19 shows, in addition to the top cap 120, end cap 122 and a corner cap 126, a post clip 127.

Each of the top cap 120 and end cap 122 are identical extrusions, preferably of aluminum, having a cross-section as best seen at the upper end of the end cap 122 in FIG. 19, and in FIG. 13, so as to define a central longitudinal slot 202 and a pair of longitudinal outer slots 201 and 203 on either side of the central longitudinal slot 202.

The post clip 127 has two downwardly extending front and rear legs 128 and 129. Each leg carries an outwardly directed catch member 130 or 131 which are adapted to resiliently engage in horizontally extending slots 132 and 133 provided respectively in the front face portion 40 and the rear face portion 41 of the post member 14 proximate the upper end 88 of the post member 14. Engagement of the catch members 130 and 131 in the slots 132 and 133 preferably locates the post clip 127 fixed both vertically and horizontally relative to the post member 14. As seen in FIG. 19, the grommet member 24 has its forward and rear arm portions 96 and 97 cut away inside of the front and rear face portions 40 and 41 so as to permit the post clip 127 to engage in the slots 132 and 133 of the post member.

The post clip 127 has a top flange 204 which has a width W and a height H such that the top flange 204 slides longitudinally into the center slotway 202 of the top cap 120. The top flange 204, as seen in side view, is asymmetrical relative to the legs 128 and 129. The top flange 204 extends, as seen in FIG. 19, towards the left as a male projection 206 to a greater extent past the legs 128 and 129 than the top flange 204 extends towards the right. The left-hand side of the top flange 204 is referred to as the male side presenting the male projection 206 which extends beyond the legs 128 and 129. The right-hand side is referred to as the female side ending at female end 208 proximate the right-hand end of the legs 128 and 129. As orientated in FIGS. 19, 20 and 21, when the post clip 127 is secured in the top cap 120 and the post clip 127 is coupled to the post member 14, the male projection 206 extends laterally to the left beyond the end surface 69 of the post member 14 and beyond the end 134 of the top cap 120.

Figure 20:
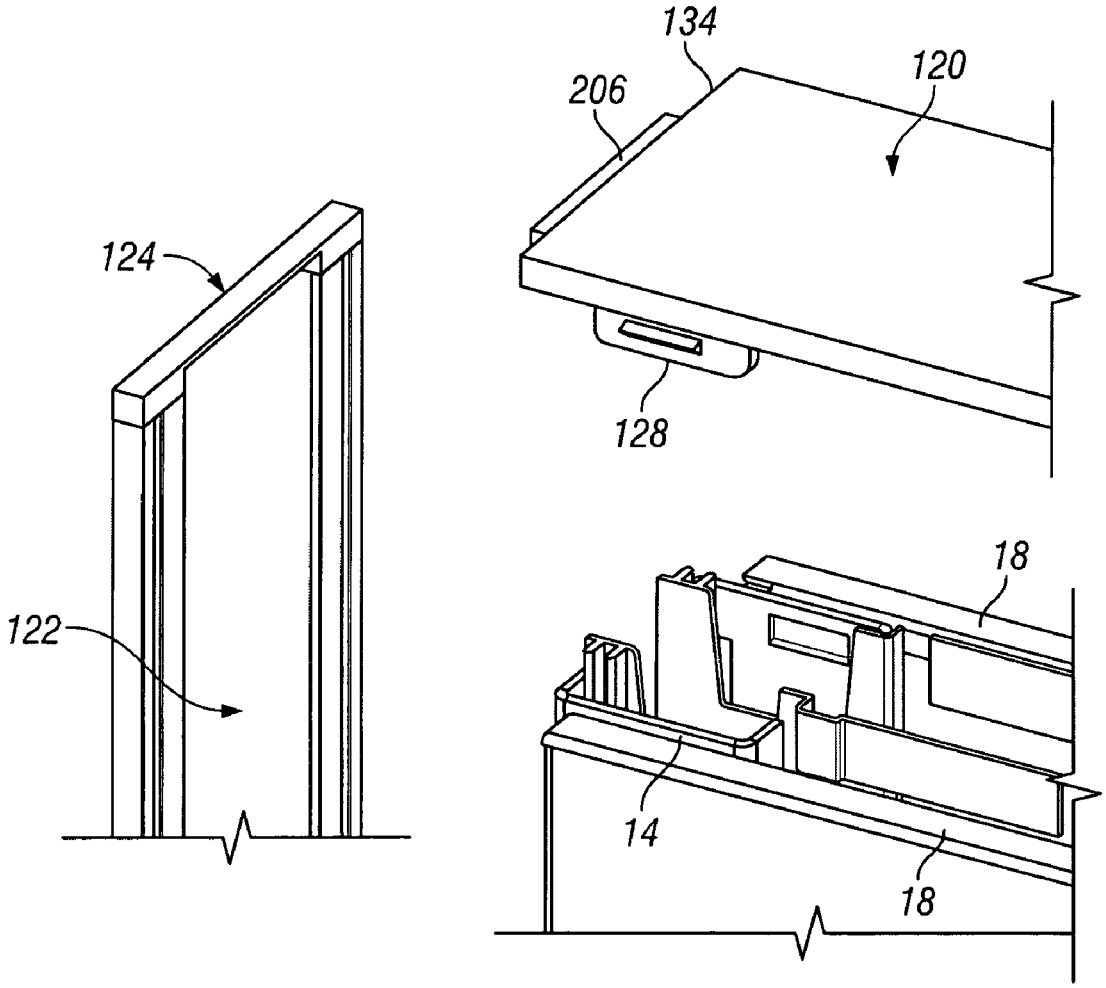
FIG. 20 is an exploded view the same as in FIG. 19 but with additional of the elements assembled.
Figure 21:
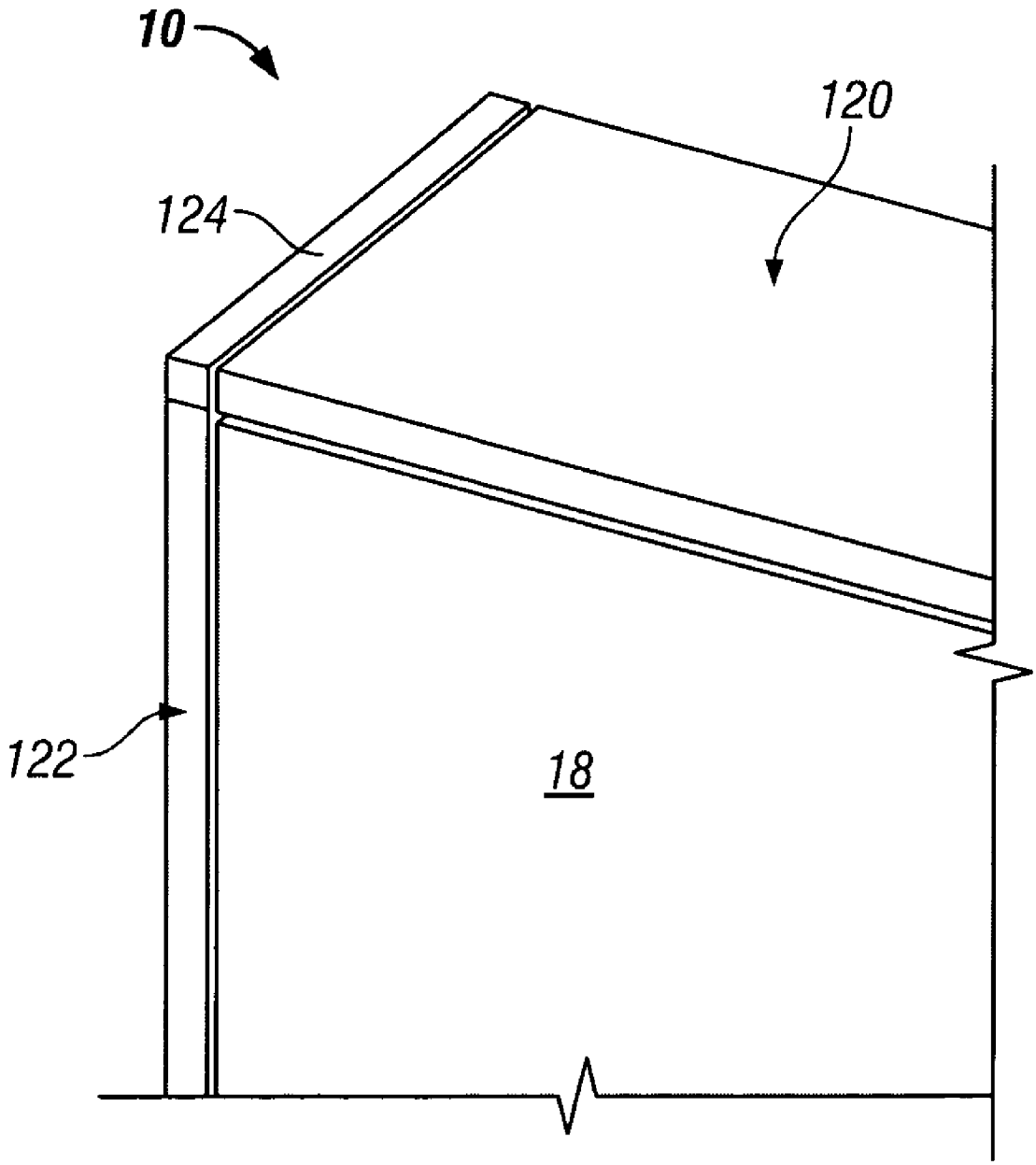
FIG. 21 is a view the same as FIG. 19 but with all of the elements assembled.

The corner cap 126 carries a pair of male legs 210 which are sized to be frictionally engaged in the outer slots 201 and 203 of the end cap 122 against removal. The corner cap 126 has a blind slotway 212 extending horizontally there into of the same dimensions as the central slotway 202 and adapted to receive the male projection 206 on the post clip 127. The engagement of the male projection 206 of the post clip 127 in the corner cap 126 serves two purposes. Firstly, the engagement permits the post clip 127 to support the weight of the corner cap 126 plus the end cap 122 vertically and, secondly, the post clip 127 serves to align the corner cap 126 and the end cap 122 side to side in alignment with the top cap 120 and to align the corner cap 126 vertically with the top cap 120. FIG. 20 shows the corner cap 126 as frictionally engaged in the end cap 122 and the post clip 127 as secured to the top cap 120. FIG. 21 shows a pictorial view of the top cap 120, end cap 122 and the corner cap 126 as applied to the partition.

Figure 22:
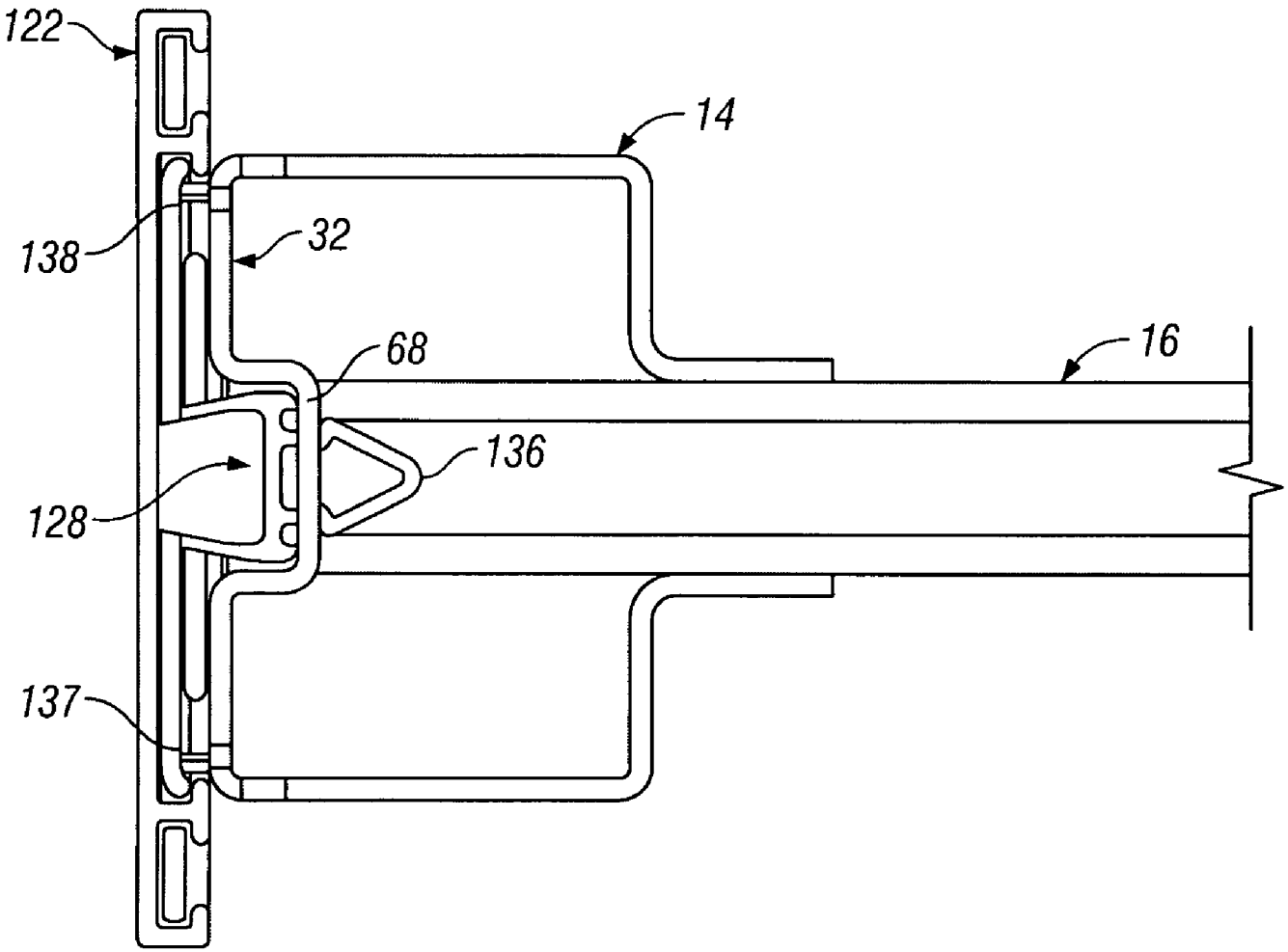
FIG. 22 is a horizontal cross-sectional view through FIG. 21 showing the manner of attachment of the end cap with the end post clip.
Figure 23:
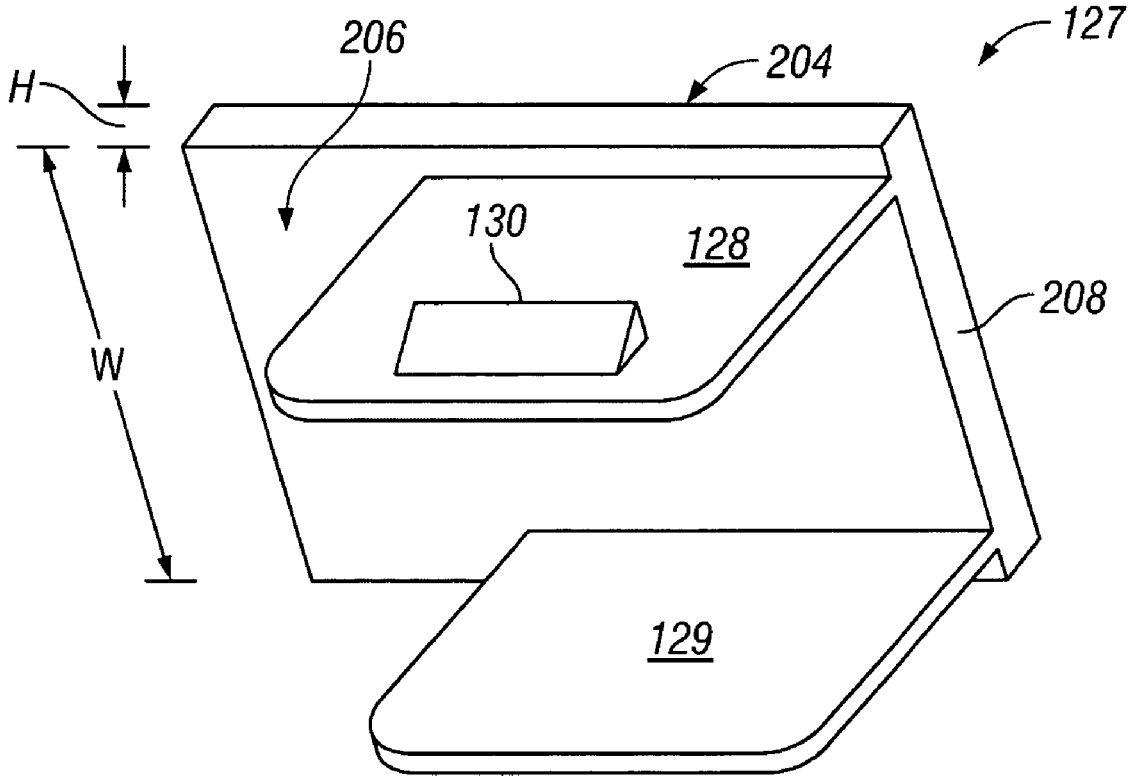
FIG. 23 is a bottom pictorial view of the post clip shown in FIG. 19.

The end cap 122 is preferably coupled to the end bight member 32 of each post member by reason of end clips 128 shown in FIGS. 2, 12 and 22 secured at vertically spaced locations on the post member. In this regard, the bight member 32 in its U-shaped channel portion 68 is provided with square openings 135, seen in FIGS. 8, 9 and 13, into which a central plug 136 of the end clip 128 is received. The end clip. 128 has a pair of sideway extending arms 137, 138 sized to be received within the central longitudinal slot 202 of the end cap 122 so as to locate the end cap 122 side-to-side and spaced horizontally from the post member 14.

In the preferred embodiments, the top cap 120 extends the entire width of the partition 10 and is preferably secured to the frame 12 merely by engagement with the post members 14 via the post clips 127. Preferably, therefore, the top cap 120 has sufficient rigidity to span across the width of the frame 12 between the post members 14 without drooping or sagging, however, if desired, then additional support may be provided via a support member from the uppermost beam 16 preferably as a clip member coupled to the upper arm portions of the channel member 22 and, for example, received in the slot 202 of the top cap 120. Each of the end caps 122 also preferably comprises a continuous member throughout the height of the partition.

Figure 24:
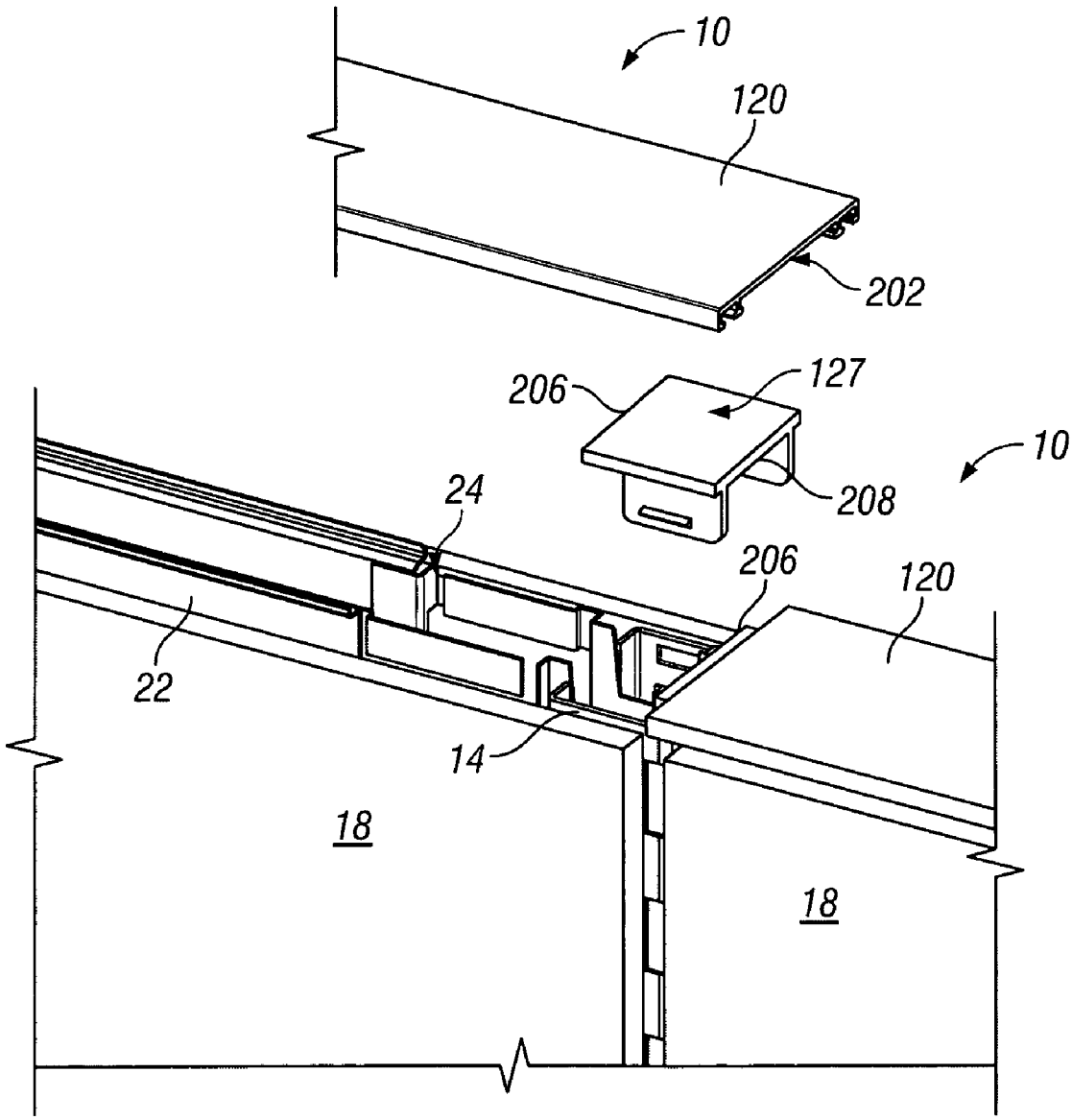
FIG. 24 is a schematic exploded pictorial view showing the top of two partitions arranged end to end from FIG. 1 and an arrangement for attaching trim members.
Figure 25:
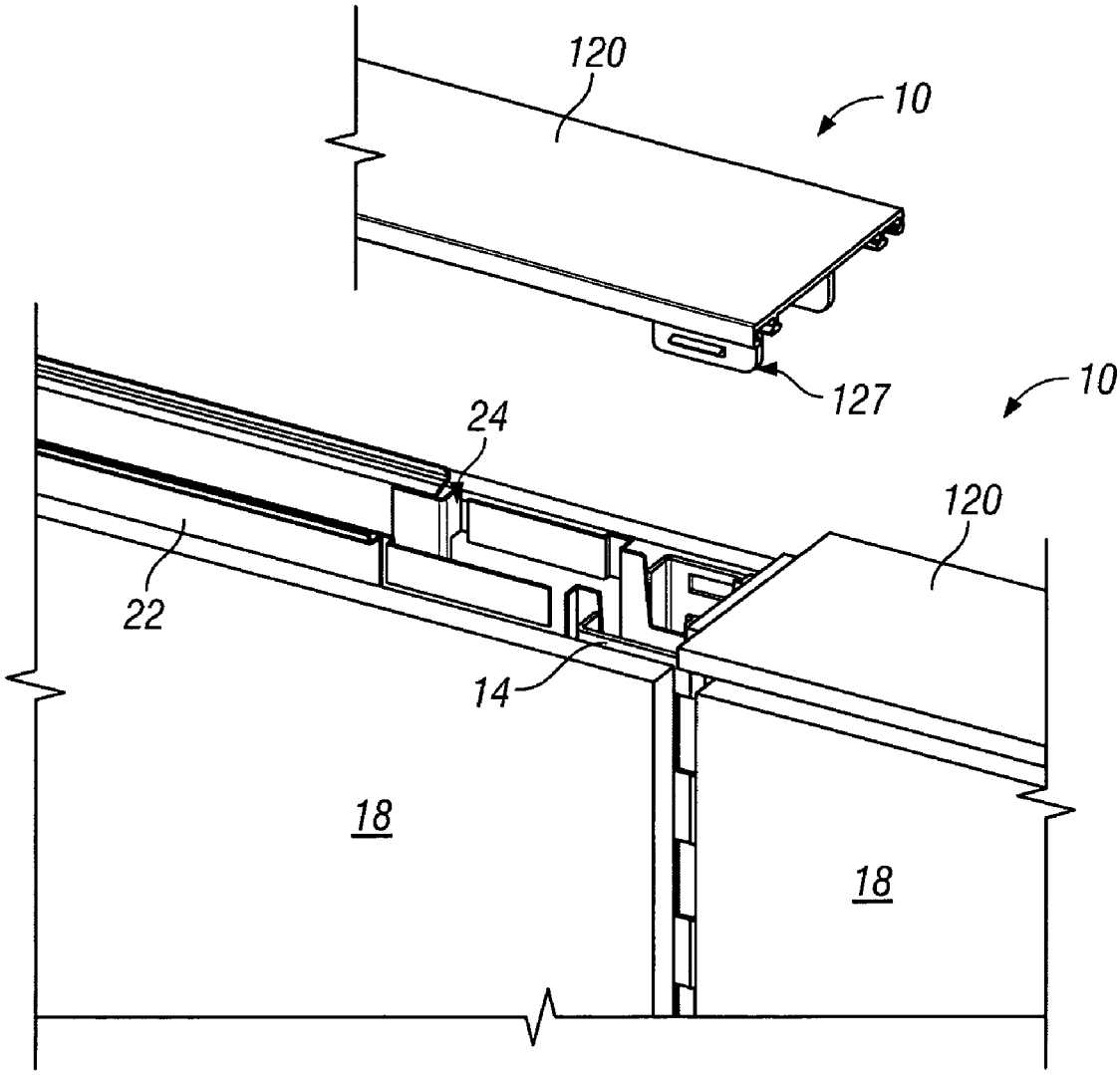
FIG. 25 is a view the same as FIG. 24 but with additional elements assembled.

Reference is made to FIGS. 24 and 25 which illustrate two partitions 10 of FIG. 1 secured end-to-end having each of their post members 14 bolted together as by threaded fasteners, not shown, such that the end surfaces 69 of the bight members 32 of each post member 14 are in abutment. In each of FIGS. 24 and 25, the right-hand-most partition 10 has its top cap 120 secured to its post member by the use of a post clip 127 in an identical manner to that shown in FIG. 19 and with the male projection 206 extending outwardly beyond the end of the right-hand side partition 10 towards the left. FIG. 24 shows an exploded view of the left-hand partition showing its post clip 127 and top cap 120. The post clip 127 for the left-hand partition is disposed to have its male projection 206 also extend to the left, that is, inwardly relative to the left-hand partition, and to present its female end 208 towards the right. When the left post clip 127 is received in the post member 14 of the left partition, the female end 208 of the left post clip 127 is recessed inwardly from the end 134 of the left top cap 120 sufficiently that the male projection 206 of the right post clip 127 may be slidably engaged into the center slot 202 in the left top cap 120. The engagement of the male projection 206 of the right post clip 127 with the left top cap 120 provides for vertical and a side-to-side alignment of the left top cap 120 with the right top cap 120.

Figure 26:
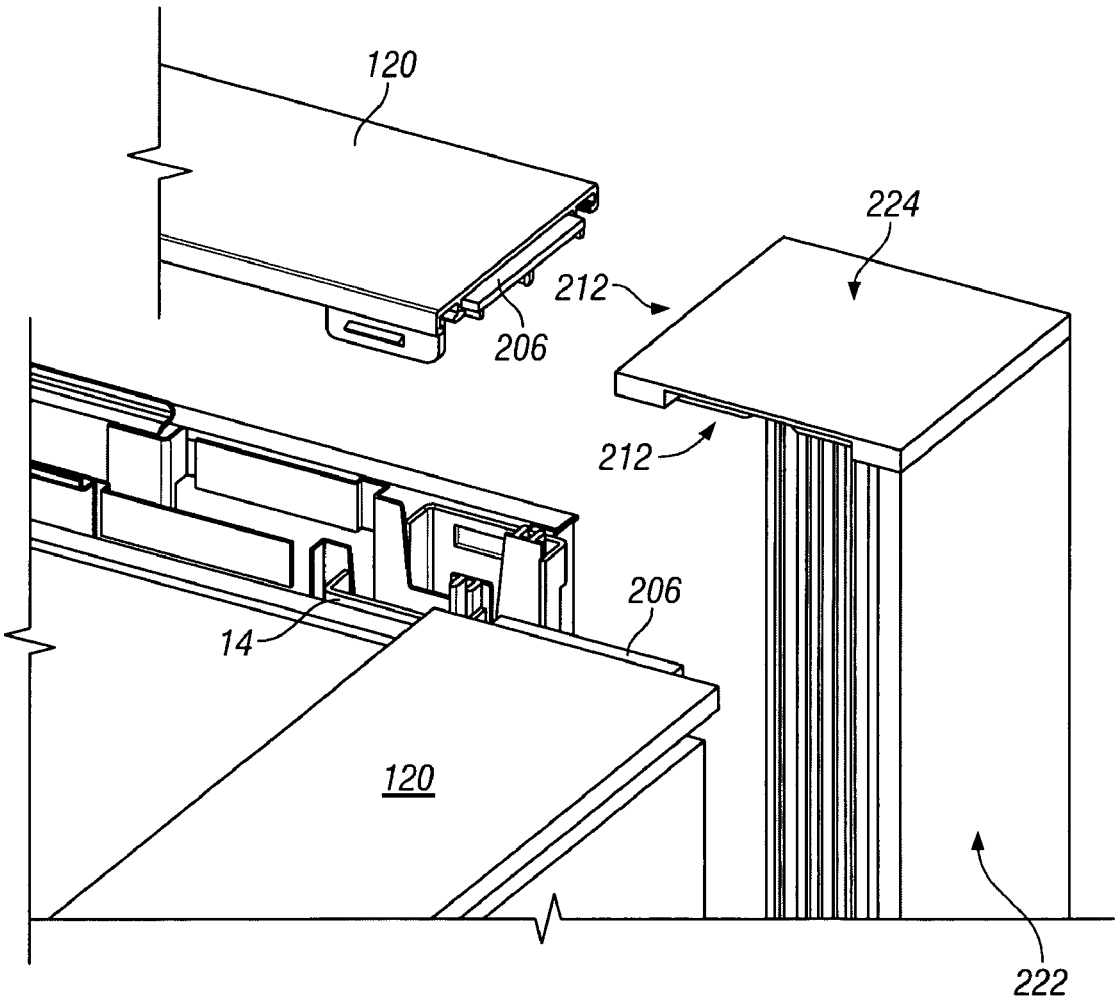
FIG. 26 is an exploded pictorial front view of the right angle junction of two partitions from FIG. 1 showing an arrangement for attaching trim members.
Figure 28:
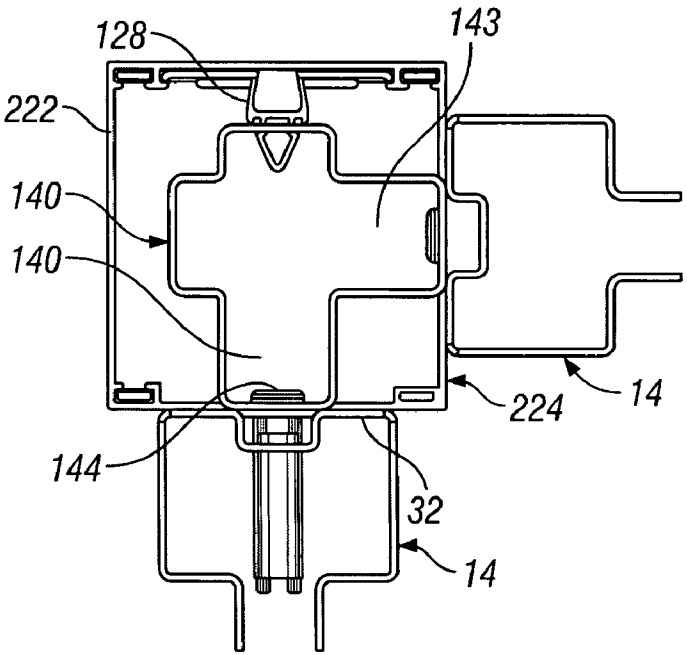
FIG. 28 is a schematic top view of the two-way connection shown in FIG. 27.
Figure 27:
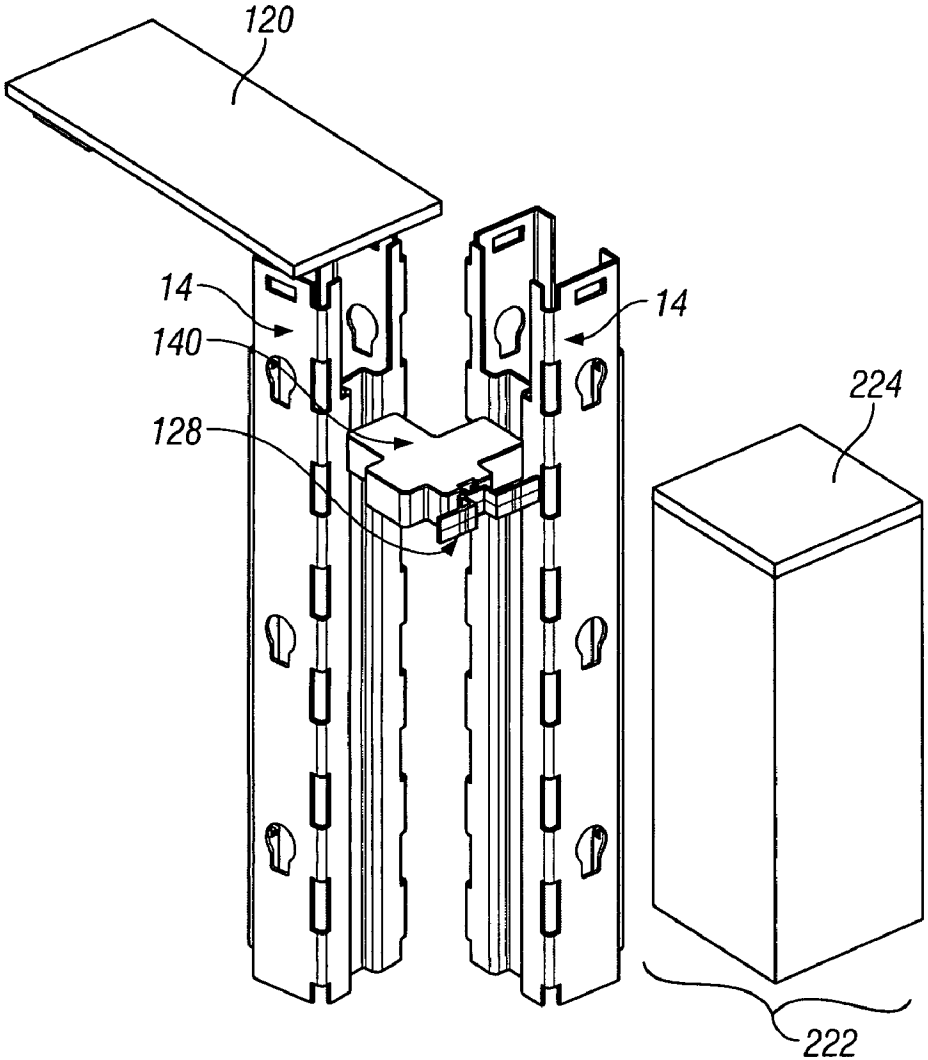
FIG. 27 is an exploded pictorial rear view of the two-way connection of partitions at right angles to each other as shown in FIG. 26 but merely showing the post members, bracket connectors and end clip.

Reference is made to FIGS. 26 to 28 which show an arrangement for the connection of the two partitions 10 as seen in FIG. 1 at right angles to each other.

Figure 29:
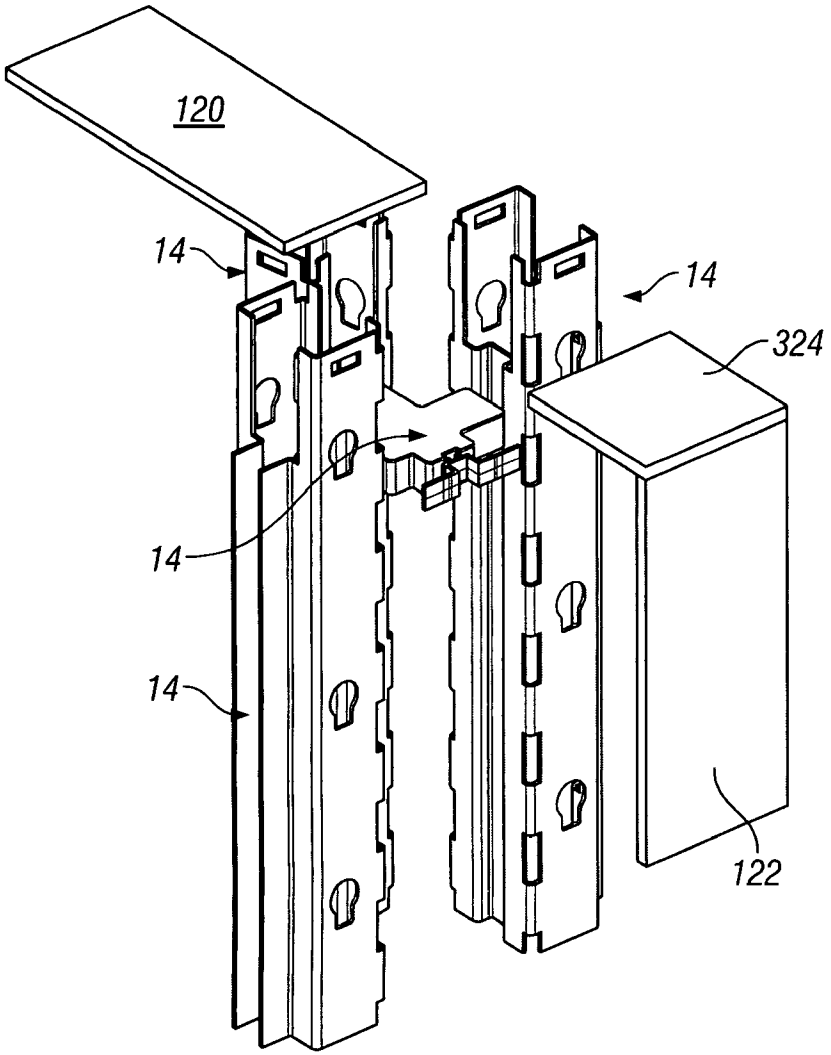
FIG. 29 is a schematic exploded pictorial view of a three-way connection of partitions showing the coupling members and trim members.

As seen in FIGS. 27 and 28, the bight members 32 forming the ends of each of the post members 14 of each partition are secured together as with a two-way connection bracket 140. FIG. 29 illustrates a view of the connection shown in FIG. 25 but from the rear as seen in FIG. 25 and merely showing the two post members, and the two-way connection bracket 140, and one end clip 128 together with a corner cap 224 and right angled end cap 222. The bracket 140 has two arms 142, 143 disposed at right angles with each arm 142, 143 having an end of each secured via a threaded fastener 144 to the bight member 32 of each post member 14 so as to fixedly secure the post members 14 together. A plurality of such brackets 140 are to be provided spaced vertically along the height of the post members received in the square openings 135 in the post member. An end clip 128 is shown snapped into a square aperture in an outer face 146 of bracket 140. The two arms 137, 138 of the end clip 128 are slidably received in the central longitudinal slot 202 of the end cap 222 as seen in top view in FIG. 30. The end cap 222 is L-shaped in top view and similar to two end caps 122 joined at right angles. As seen in FIG. 26, each top cap 120 of each partition is secured to its end post member 14 by a respective post clip 127 which is orientated such that its male projection 206 protects outwardly beyond the end of the partition. The corner cap 224 is square in shape and has in each of its two end faces 148 and 149, a slotway 212 similar to the slotway 212 in the corner cap 126 in FIG. 19. The end cap 222 is fixedly secured to the corner cap 224 as by legs extending downwardly from the corner cap 224. By reason of the engagement of the male projections 206 in the two slotways 212 of the corner cap 224, the corner cap 224 and the end cap 222 are supported vertically and aligned side-to-side and vertically relative to each of the two top caps 120.

Reference is made to FIGS. 29 to 32 which illustrate a manner of arranging for three-way and four-way right angle connection of partitions similar to that shown for a two-way right angle connection in FIGS. 26 to 28.

Figure 30:
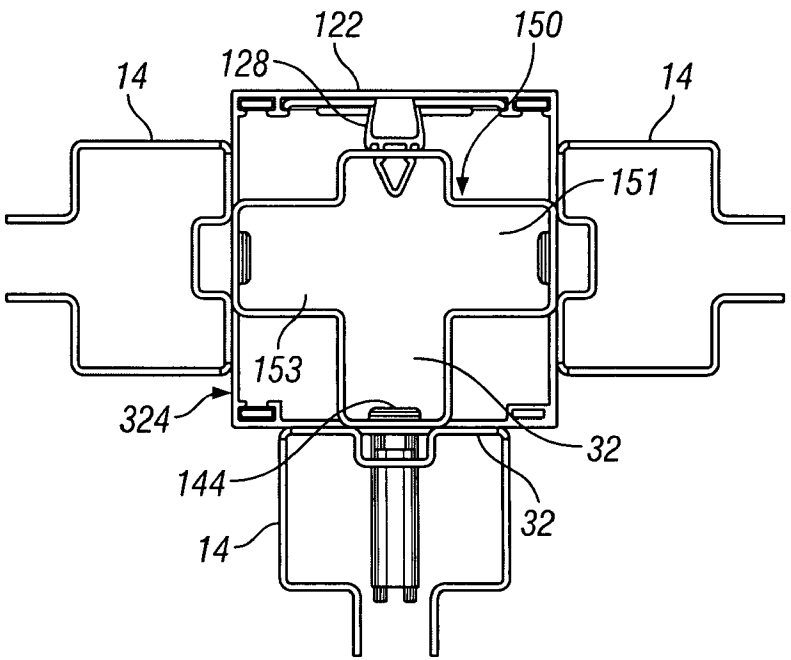
FIG. 30 is a schematic top view of the three-way connection shown in FIG. 29.

Reference is made to FIGS. 29 and 30 which show a three-way connection of three posts with a connection bracket 150 having three arms 151, 152 and 153 disposed at right angles to each other and each adapted to be secured as by a threaded fastener 144 to the bight member 32 of a post member. In FIG. 29, an end cap 122 is connected to a square top cap 324.

Figure 32:
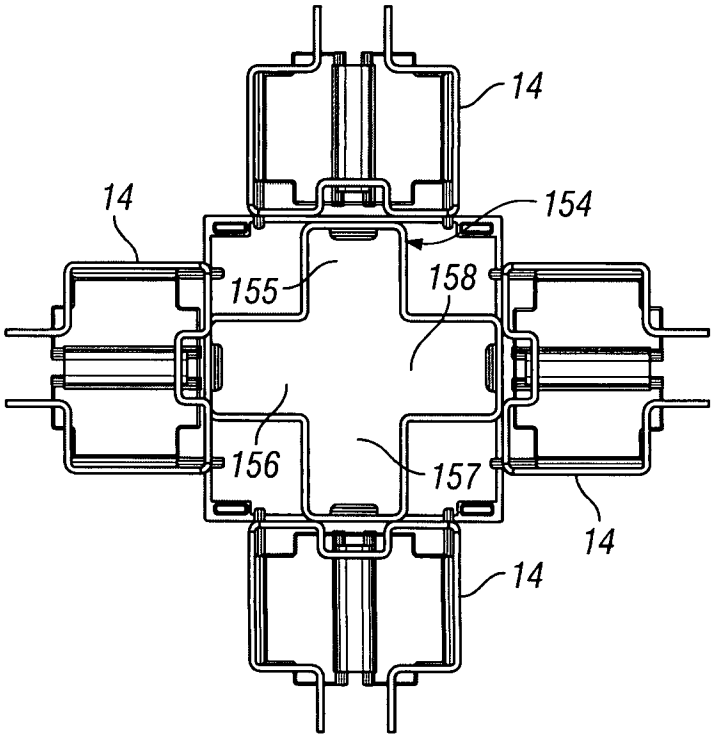
FIG. 32 is a schematic top view of a four-way connection of partitions as shown in FIG. 31.
Figure 31:
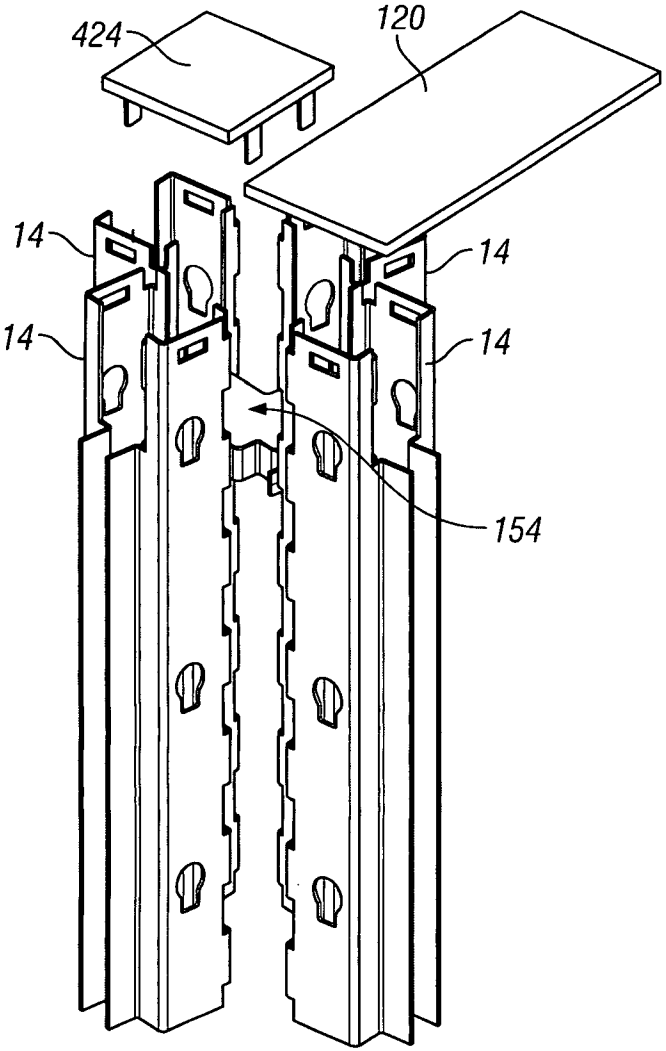
FIG. 31 is an exploded schematic pictorial view of a four-way connection of partition members.

Reference is made to FIGS. 31 and 32 which show a connection bracket 154 with four arms 155, 156, 157 and 158 disposed at right angles to each other and each arranged to connect four post members together at right angles to each other. In FIG. 31, a square end cap 424 is shown ready for use.

FIGS. 2, 10, 13 and 15 illustrate an embodiment of a post clip 127 which is different than that illustrated in FIGS. 19 to 26 in firstly being generally symmetrical about its front and rear legs 128 and 129 and, secondly in having, as best seen in end view in FIG. 13, its top flange 204 is divided into two portions joined by a U-shaped bight portion 160 which can assist in providing side-to-side resiliency to the post clip.

Figure 33:
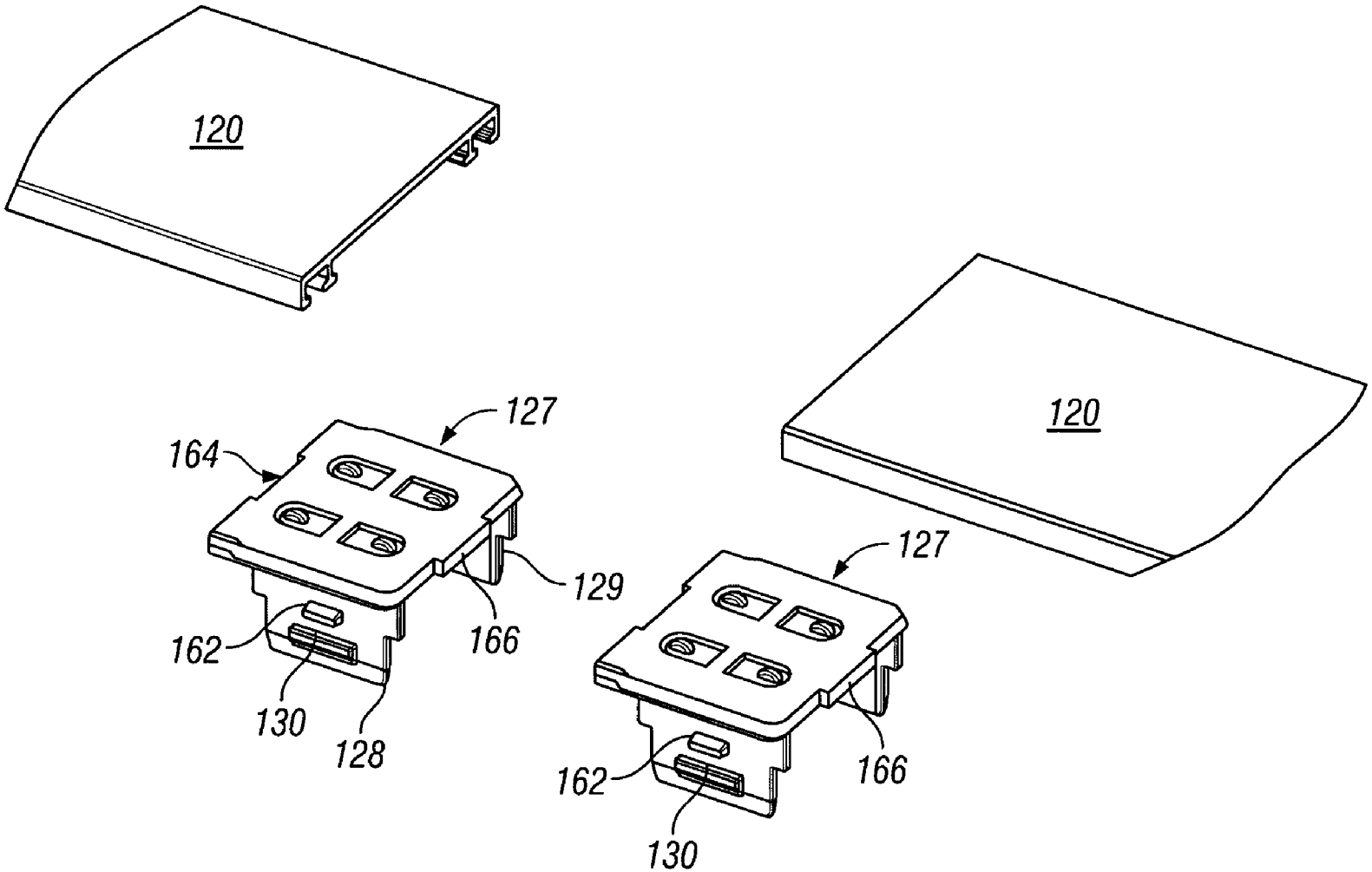
FIG. 33 is an exploded schematic pictorial view showing an alternate embodiment of a post clip for use in attaching trim members.

Reference is made to FIG. 33 which illustrates a modified version of the post clip 127 shown in FIGS. 19 to 25. The post clip 127 in FIG. 33 has, in addition to the catch member 130, a second locating tab 162 to engage the uppermost edge of the post member and further assist in locating the post clip 127 vertically. The male projection 206 includes a central slotway 164 which is sized and adapted to be engaged by a complementary sized tab 166 carried on the female end of the post clip 127. In an in line end-to-end alignment of partitions 10, as shown in FIG. 24, the modified post clip 127 provides for additional side-to-side alignment of the top caps 120 by reason of the tab 186 being received in the slotway 164.

Channel Member

Figure 10:
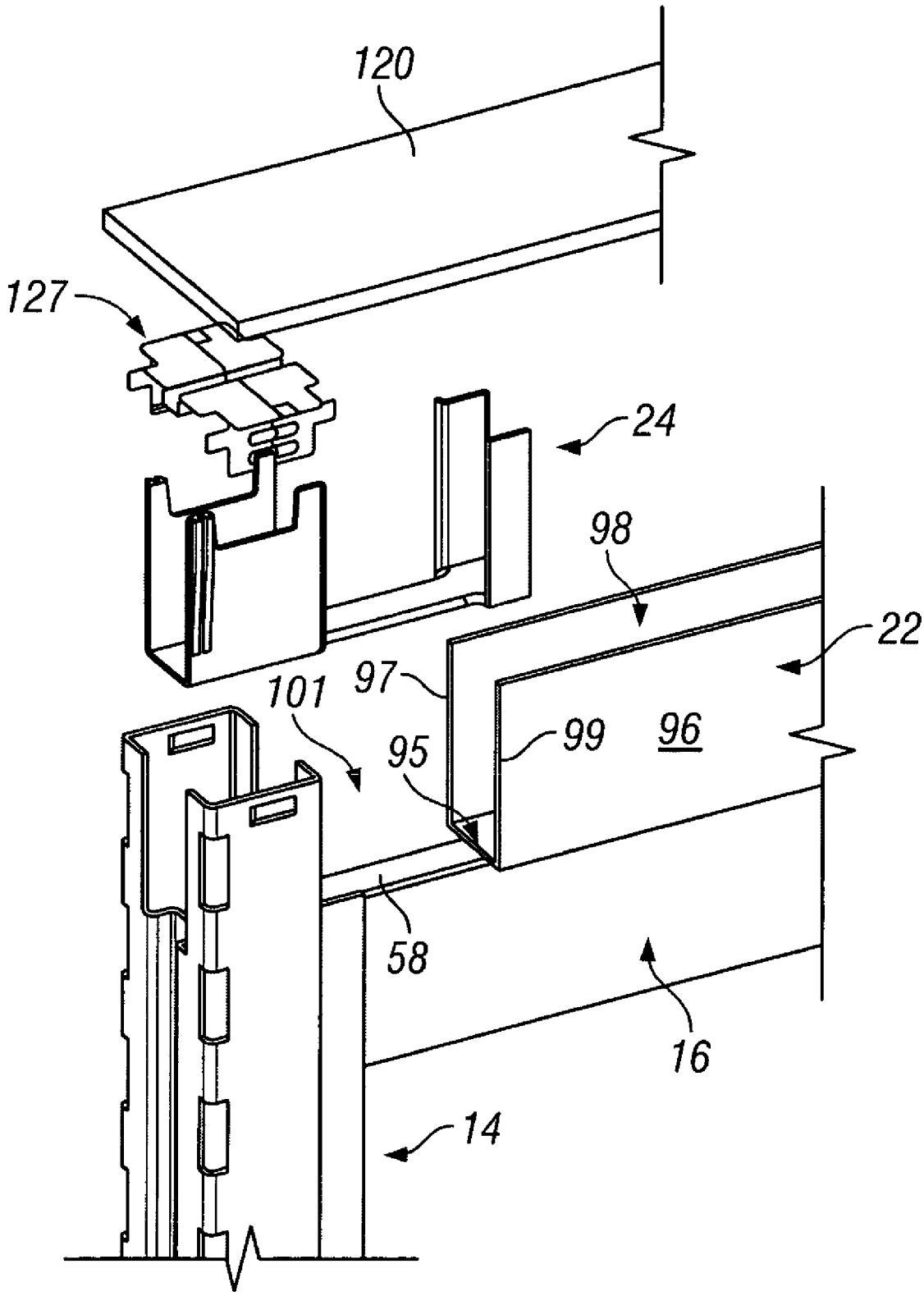
FIG. 10 is an enlarged exploded pictorial view of the upper left-hand corner portion of the partition shown in FIG. 2 within the circle.
Figure 11:
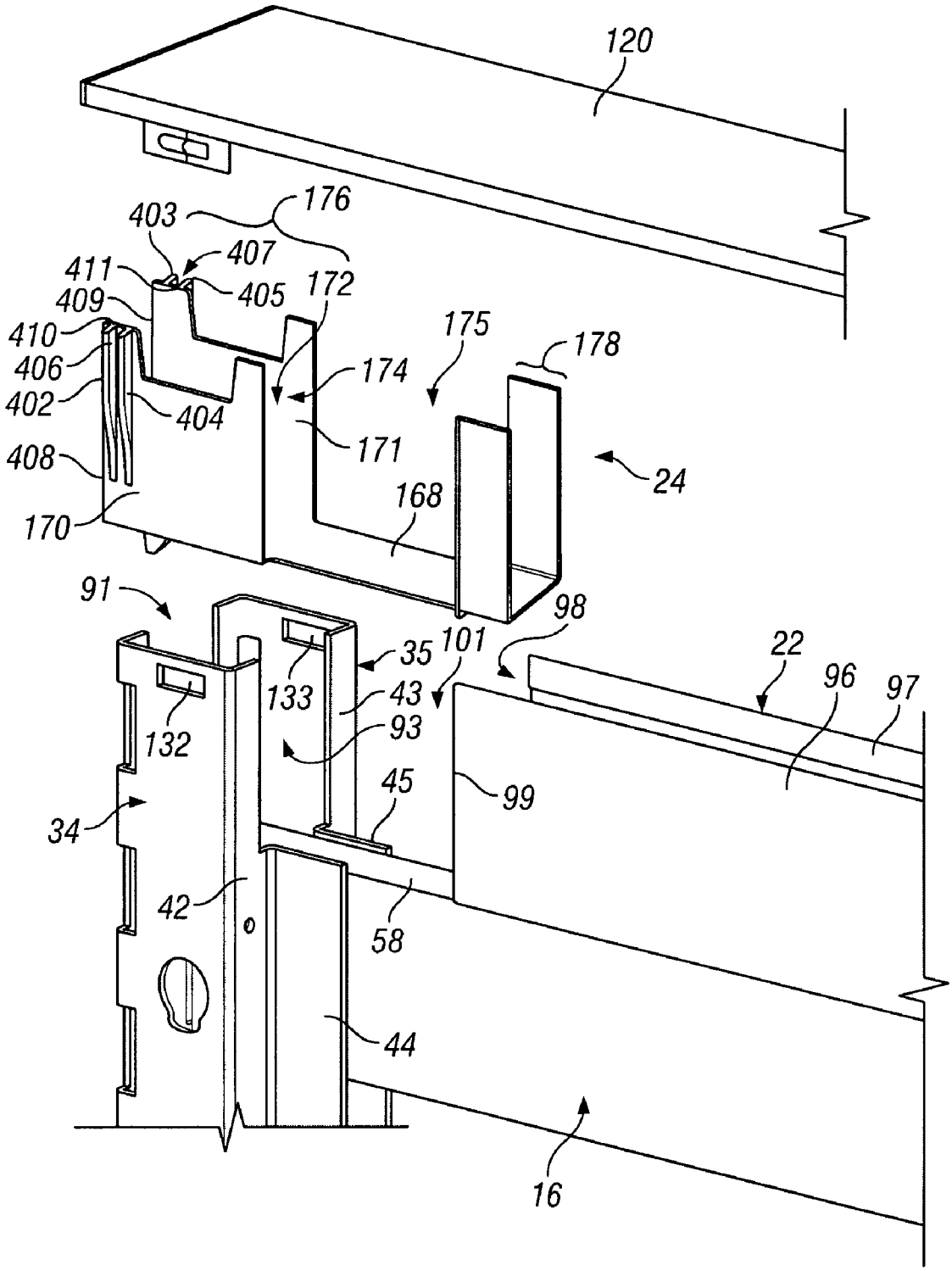
FIG. 11 is an exploded pictorial view showing similar components to those shown in FIG. 10 but as viewed from the front right-hand end.

As seen in FIG. 11, the channel member 22 is fixedly secured to the top 58 of the uppermost beam member 16. The channel member 22, as seen in FIGS. 9 and 10, is preferably a U-shaped member with a bottom bight portion 95 from which front and rear arm portions 96 and 97 extend upwardly presenting an upwardly opening passageway 98. The front to back spacing between the front arm portion 96 and the rear arm portion 97 preferably match the width across the exterior top slot 91 and the interior top slot 93 of the post member. The channel member 22 is preferably formed from a lightweight sheet of metal bent to have the desired shape and with the top edges of the front arm portion 96 and rear arm portion 97 folded back upon themselves to provide rounded upper edges.

As seen in FIG. 10, the channel member 22 has an end 99 which is spaced from the post member 14 providing the open gap 101 therebetween.

In the preferred embodiment, the channel member 22 is provided within the upper raceway 102 which channel member is of assistance in maintaining wiring above the uppermost beam member 16 within the passageway 98 defined by the channel member 22. The channel member 22 is, however, unnecessary.

Grommet

As seen in FIGS. 10, 11, 12 and 13, the grommet member 24 is adapted to be received within the channelway 100 of the post member 14 and within the channel member 22. The grommet member 24 is not necessary but preferred. The grommet member 24 is preferably an insert preferably of plastic material which will cover any sharp edges of the post member 14 and the channel member 22, so as to provide protection for any wiring which may be laid in, drawn through or which is provided in the partition 10.

The grommet member 24 is seen in FIG. 11 as having a bottom wall 168 from which front and rear walls 170 and 171 extend upwardly presenting an upwardly opening passageway 172. The front and rear walls 170 and 171 are cut away between their ends so as to provide openings 174 and 175 therethrough complementary to the gap 101 between the post member 14 and the end 99 of the channel member 22. The grommet member 24 can be characterized as having a U-shaped upwardly opening post grommet portion 176 within the channelway 100 through the upper end of the post member 14 and, as well, a similar U-shaped upwardly opening channel grommet portion 178 within the end of the channel member 22. The post grommet portion 176 and the channel grommet portion 178 are connected by a bridging portion of the bottom wall 168. One embodiment of the grommet member 24 is illustrated in FIGS. 2, 10, 11 and 15 and a second similar embodiment is illustrated in FIGS. 17, 18, 19 and 20. In the second embodiment of FIG. 17, two flexible front and rear flap members 180 and 181 are provided to bridge across the gap 101. The front flap member 180 is connected to the front wall 170 of the grommet member 24 proximate the post member 14 and extends to a distal end 182. The rear flap member 181 is shown as connected to the rear wall 171 of the grommet member where it is received in the channel member 22 and extending towards the post member to a distal end 183. Each flap member 180 and 181 functions as a light seal member to block light passing through a gap 192 shown in FIG. 13 between the top cap 120 and the upper edge portion of the upper cladding panel 18 over the gap 101 between the post member 14 and an end 99 of the channel member 22. Each of the flap members 180 and 181 are made of resilient material which have an inherent tendency to assume the light blocking configuration shown in FIG. 17, however, may have their distal ends 182, 183 deflected forwardly or rearwardly as to assist in permitting wires to extend through the gap 101 from the upper raceway 102 down into either the front or rear vertical raceways 86 and 87.

Light Seal

Figure 15:
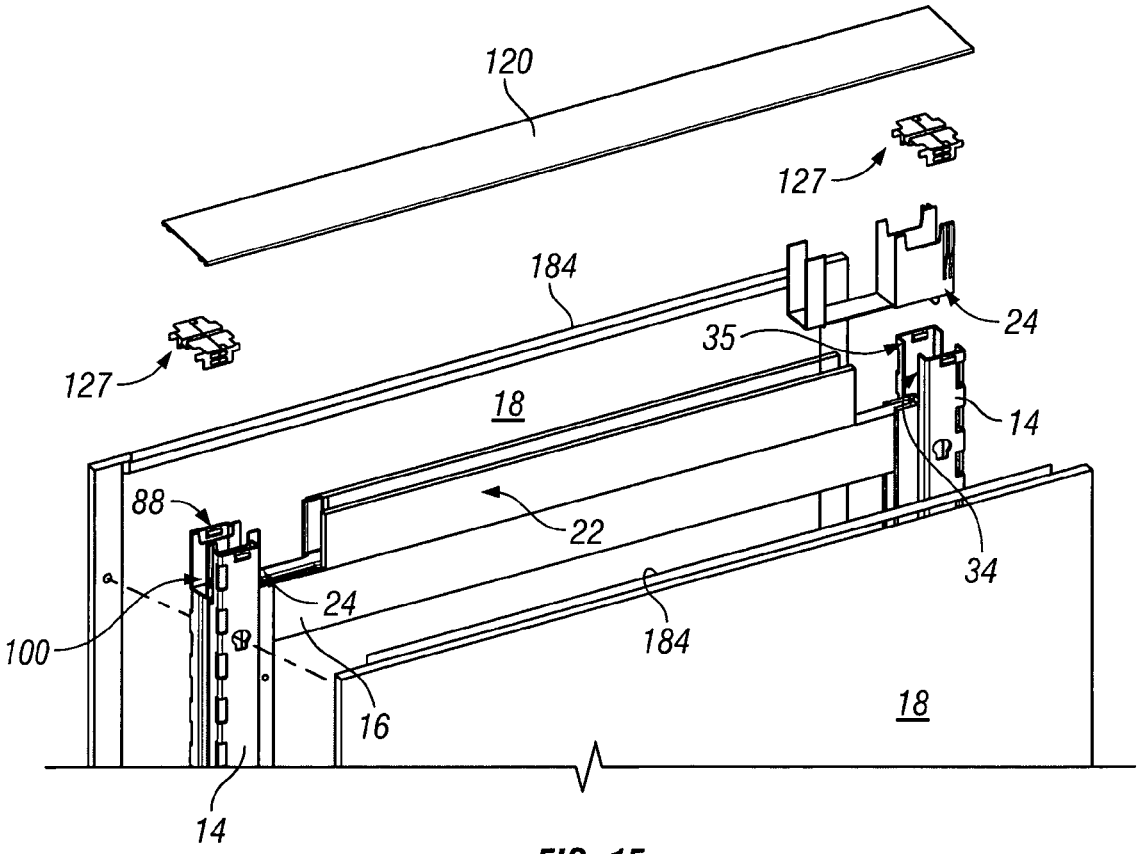
FIG. 15 is a pictorial schematic exploded view showing uppermost portions of the partition of FIG. 2 including two upper cladding panels positioned for coupling.
Figure 16:
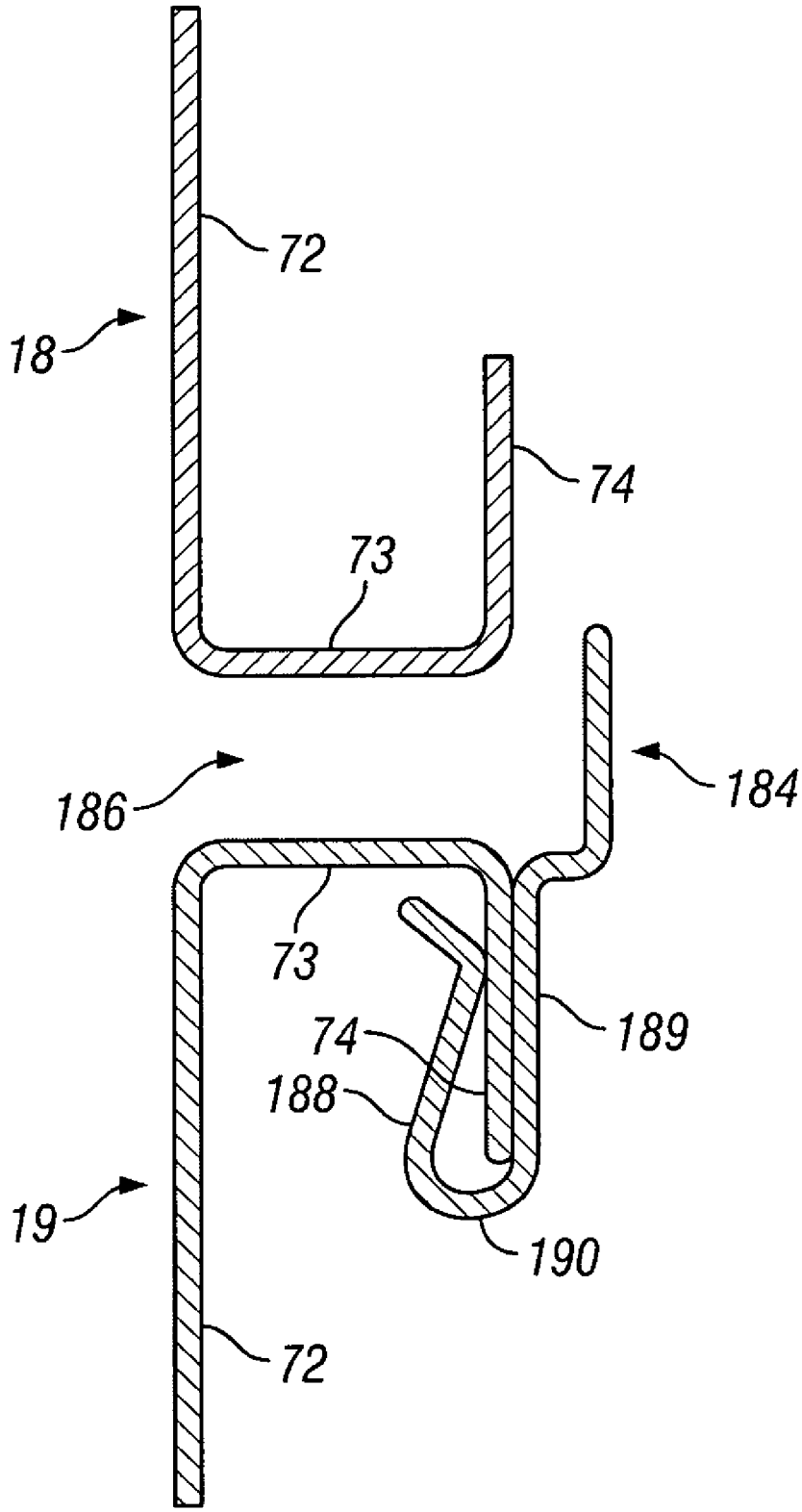
FIG. 16 is a vertical cross-section through the abutting upper and lower ends of the rear upper and middle cladding panels shown in FIG. 8 showing a light seal carried by the middle cladding panel.
Figure 17:
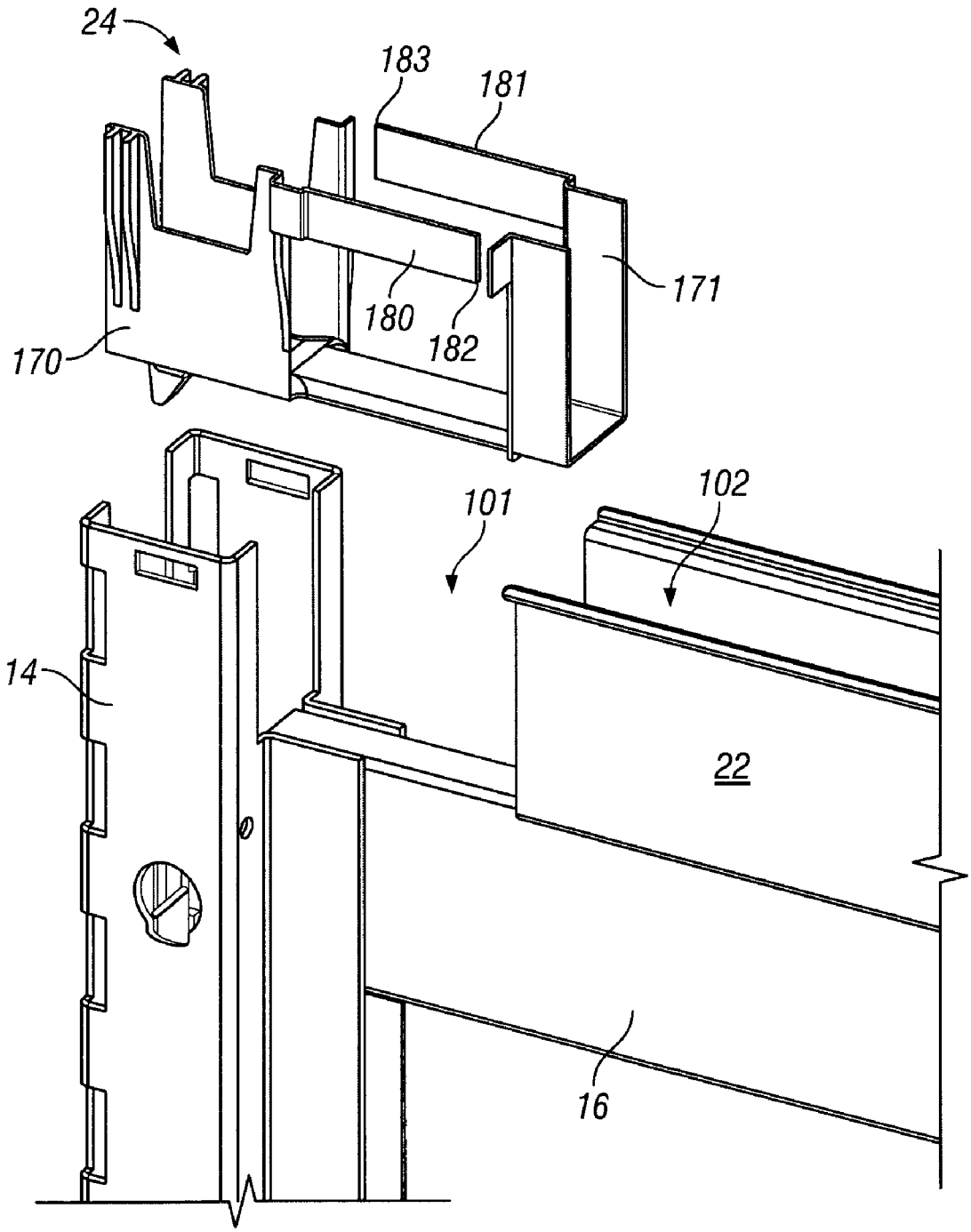
FIG. 17 is an exploded pictorial view similar to FIG. 11 but showing a modified form of the grommet member.

Reference is made to FIGS. 13, 15 and 16 which illustrate a light seal member 184 in accordance with the present invention. FIG. 16 shows the light seal member 184 in a vertical cross-sectional side view would be found in the context of FIG. 8 between the lower edge of an upper cladding panel 18 and the upper edge of an intermediate cladding panel 19 as in the circle on the left-hand side of the partition 10 shown in FIG. 8. As seen in FIGS. 8 and 16, the edge portion 73 of the upper cladding panel 18 is spaced from the edge portion 73 of the intermediate cladding panel 19 by a gap 186. The light seal member 184 is shown in FIG. 8 secured to the return flange 74 of the intermediate cladding panel 19. The light seal member 184 is a substantially U-shaped clip with a forward arm 188 joined to a rear arm 189 by a bight member 190. The light seal member 184 engages on the return flange 74 such that the rear arm 189 extends upwardly past the edge portion 73 so as to overlap vertically with the edge portion 73 of the upper cladding panel 18 and thus prevent light from passing through the gap 186 between the cladding panels as when viewed horizontally from the front of the partition 10. The light seal member 184 preferably comprises an extrusion of plastic or metal which has an inherent resiliency such that the front arm 188 and rear arm 189 must be biased apart to receive the return flange 74 therebetween and inherently clamp the return flange 74 therebetween against removal.

The light seal member 184 is useful to block light passing above or below the edge of the cladding panels to which it is attached. The light seal 184 is useful as applied to the return flange 74 at the top of each upper cladding panel 18. FIG. 15 shows the light seal members 184 applied to the front and rear upper cladding panels 18 on the return flange 74 at the upper edge thereof so as to extend upwardly towards the top cap 120. As may be seen in FIG. 13, for decorative purposes, a gap 192 is provided between the top cap 120 and the edge portion 73 of the upper cladding panels. As also seen in FIG. 13, the channel member 22 extends upwardly to closely underlie the top cap 120 such that no light seal is required between the top cap 120 and the channel member 22, however, a light seal is desired in the gaps 101 between the post members 14 and the channel member 22. In FIG. 13, each light seal member 184 has its rear arm 189 extend upwardly so as to block light passing through the gap 192 as is particularly useful over the gaps 101.

Post

Reference is made to FIG. 9 which shows a view of the post member 14 and various openings cut into the surfaces of the post member. As seen in FIG. 9, the keyhole slots 79 are provided in the front face portion 40. Near the upper end 88 of the post, the slot 132 is provided in the front face portion 40 for engagement by the top post clip 127. A row of vertical rectangular accessory mounting slots 194 are provided in the front face portion 40 proximate the bight member 32 for the support of accessories exemplified by the bracket members 195 shown in FIG. 2. The bracket members 195 have T-shaped connectors 196 adapted to be received in the slots 194 in a known manner. The accessory mounting slots 194 are also shown in FIG. 4. In FIG. 4, the U-shaped channel portion 68 of the bight member 32 extends inwardly from the end surface 69 beyond the inward extent of the accessory mounting slots 194 such that light will not pass horizontally through the post member 14 between slots 194 and a separate light seal is therefore not required.

FIGS. 8, 9 and 13 show in the U-shaped channel portion 68 of the bight member 32 a series of small spaced rectangular openings 135 which are adapted to receive plugs 136 of the end clips 128 or fasteners to secure post members end-to-end or to connecting brackets for connection to other post members. Two larger rectangular openings 197 are provided in the U-shaped channel portion 68 of the bight member 32 aligned into the end of the beam member 16 and which openings 197 can be of assistance in welding the end 62 of the beam member 16 to the inner bight surface 64 of the bight member 32.

In the preferred embodiment, the post member 14 is made from a singe piece of sheet metal. The post member 14 may preferably be cut from the sheet of metal and the various openings cut therefrom before the sheet is bent into the desired shape.

Figure 34:
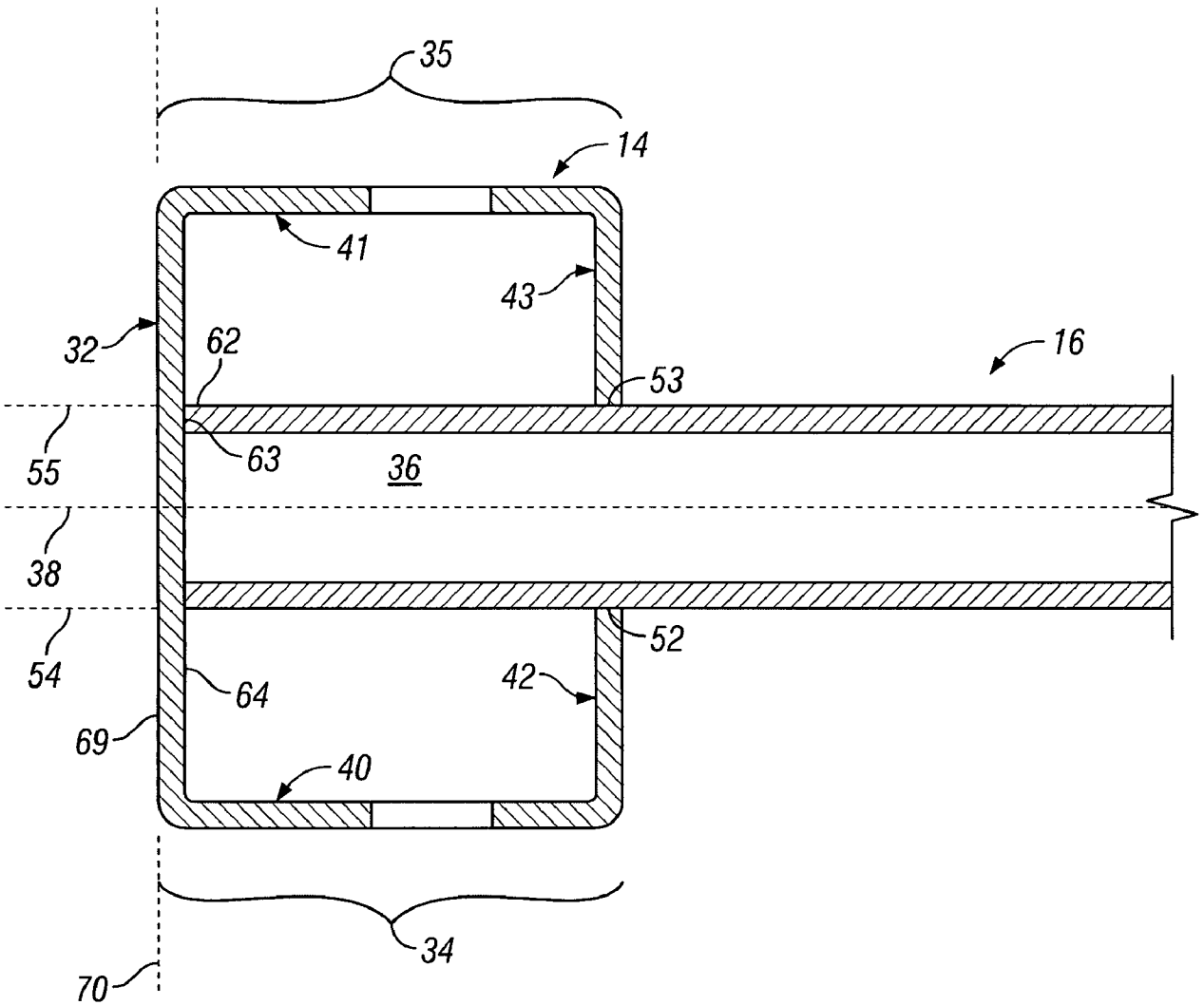
FIG. 34 is a cross-sectional view of a post member and a beam member substantially identical to that shown in FIG. 5 but illustrating a second embodiment.

Reference is made to FIG. 34 which illustrates a second embodiment of a post member 14 for replacement of the post members 14, for example, seen in FIG. 5. In FIG. 34, similar reference numerals are used to refer to equivalent elements. In FIG. 34, the post member 14 also comprises an end bight member 32, a front leg member 34 and a rear leg member 35. The end bight member 32 is provided with a continuous end surface 69 disposed in the end plane 70 normal to the center plane 38. The front leg member 34 includes the front face portion 40 and a front return shoulder portion 42. The front return shoulder portion 42 extends to the forward inner plane 54 and presents a front flank surface 52 in the forward inner plane 54. Unlike the embodiment illustrated in FIG. 5 which has a front flank portion 44, in the embodiment of FIG. 34, the front flank portion 44 is eliminated and the front flank surface 52 is merely provided at the inner end of the front return shoulder portion 42. In FIG. 34, the rear leg member 35 is symmetrical to the front leg member 33 about the center plane 38.

In FIG. 34, the beam member 16 extends through the slotway 36 provided in the post member 14 with the end 62 of the beam member having its end face 63 engaged and coupled to the inner bight surface 64. The beam member 16 and post member 14 may be welded together both at the end face 63 of the beam member 16 and at the front flank surface 52 of the post member 14.

Figure 35:
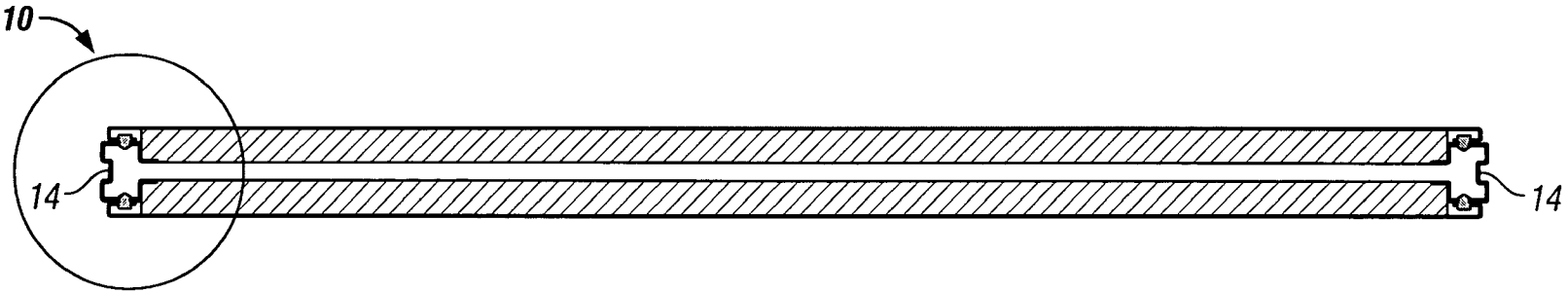
FIG. 35 is a horizontal cross-section through an assembled frame as in FIG. 7 but showing an alternate embodiment with a different configuration of cladding panels.
Figure 36:
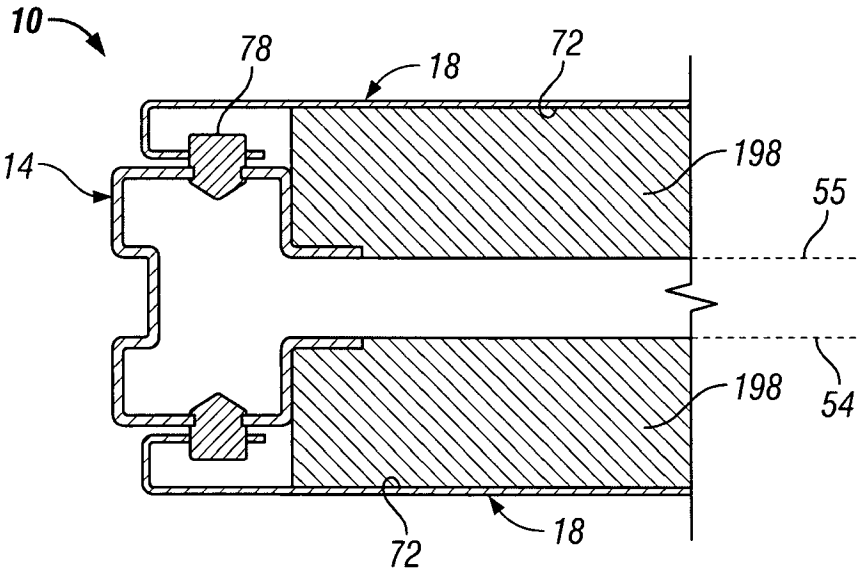
FIG. 36 is an enlarged view of FIG. 35 in the circle.

Reference is made to FIGS. 35 and 36 which show an alternate construction for a partition 10. In the embodiment of FIGS. 35 and 36, the frame 12 has identical construction of two spaced vertical post members 14 which are to be, in the same manner as indicated in FIG. 3, joined by horizontal beam members 16. Similarly, cladding panels such as upper cladding panel 18 are provided removably coupled to the post members as with hook member 78. However, inside the inner face of the cladding panel 18 formed by the main face 72, a sheet 198 of material is provided so as to fill the space inward of the inner face of the cladding panel 18 and the forward inner plane 54 or the rearward inner plane 55. The material may preferably be selected from an insulating material such as mineral wool, preferably in the form of a relatively rigid bat.

Figure 37:
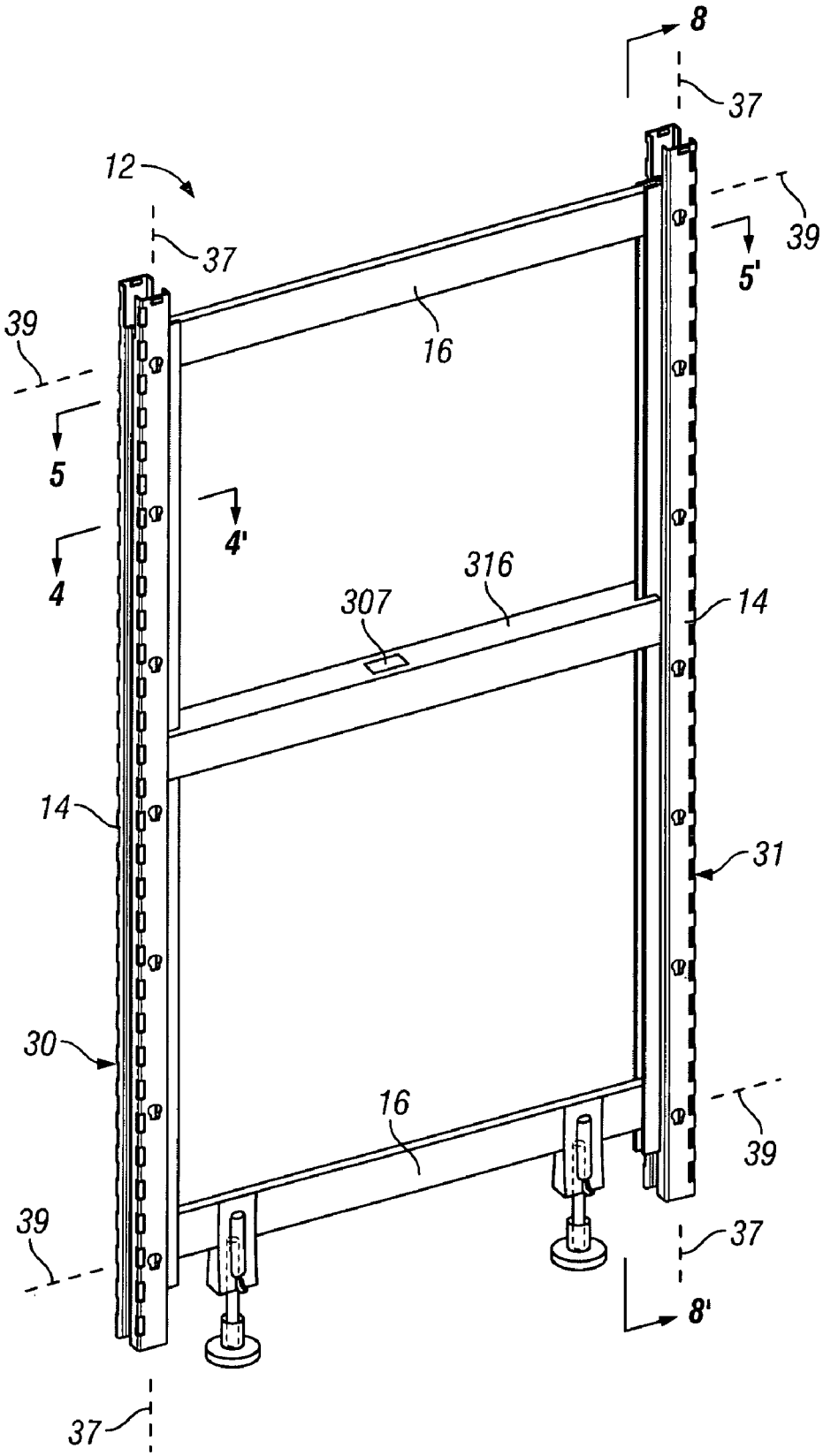
FIG. 37 is a pictorial view similar to FIG. 3 of another embodiment of a frame for a partition in accordance with the present invention.
Figure 38:
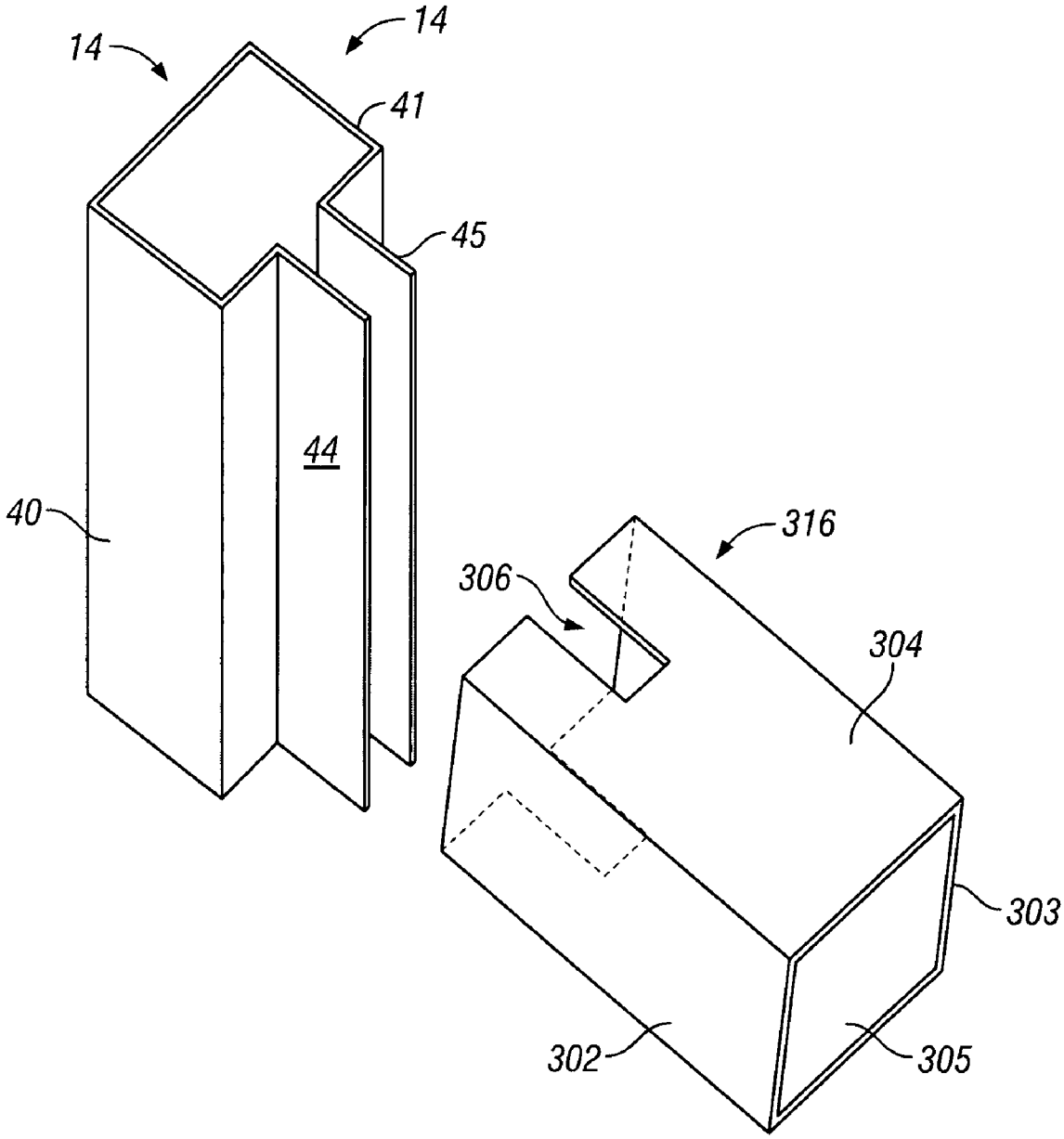
FIG. 38 is a schematic exploded view showing a connection of one end enlarged of the beam member in FIG. 37 with the post member.

Reference is made to FIGS. 37 and 38 which show an alternate construction for a frame for a partition 10 in accordance with the present invention. The frame illustrated in FIG. 37 is identical to the frame illustrated in FIG. 3 with the exception that the an intermediate beam member 316 has been added as a reinforcing beam member which extends the full front to back width of the post members 14. As seen, for example, in FIG. 38, the beam member 316 comprise a tubular member with a front 302, a rear 303, a top 304 and a bottom 305. At each end, the beam member 316 is provided with U-shaped slots 306 sized to receive the front flank portion 44 and the rear flank portion 45 of the post member 14 therein. The entire end surface of the beam 316 may be secured to the post member 14 as by welding. The beam member 316 may provide increased structural strength and rigidity to the frame 12. As in the embodiments illustrated with reference to FIGS. 1 to 5, in the embodiment of FIG. 37, front raceway 86 and a rear raceway 87 continue to be provided, however, these raceways do not extend vertically past the beam member 316 at least inwardly of the front face portion 40 and the rear face portion 41 of the post member 14. If desired, openings 307 vertically through the beam member 316 for passage of wiring.

In the embodiment illustrated in FIG. 37, the functionality of the partition in permitting the laying in of wiring in the horizontal upper raceway and downwardly past the uppermost beam member is maintained, and the functionality of the partition in permitting laying in of wiring in the horizontal lower raceway and upwardly past the lowermost beam member is maintained.

The beam member 316 may be provided as in the embodiment illustrated in FIGS. 2 and 14 in substitution for any one of the uppermost intermediate or lowermost beam member 16 and provided that at least one of the uppermost beam member or lowermost beam member 16 of FIG. 14 is maintained, then the functionality of the horizontal upper or lower raceway and a vertical raceway at least vertically past the uppermost or lowermost beam member would be maintained.

While the beam member 316 has been shown to extend the full front to rear width of the posts, it is to be appreciated that other beam members which only partially block the vertical front and rear raceways may be provided. The beam members such as beam member 316 which are to provide a reinforcing function may extend horizontally or diagonally and a plurality of interlocking such beam members may be provided such as, for example, with one beam member of a lesser width front to back on one forward side of the front flank portion 44 and another beam member of lesser width front to back on the rearward side of the rear flank portion 45.

Figure 39:
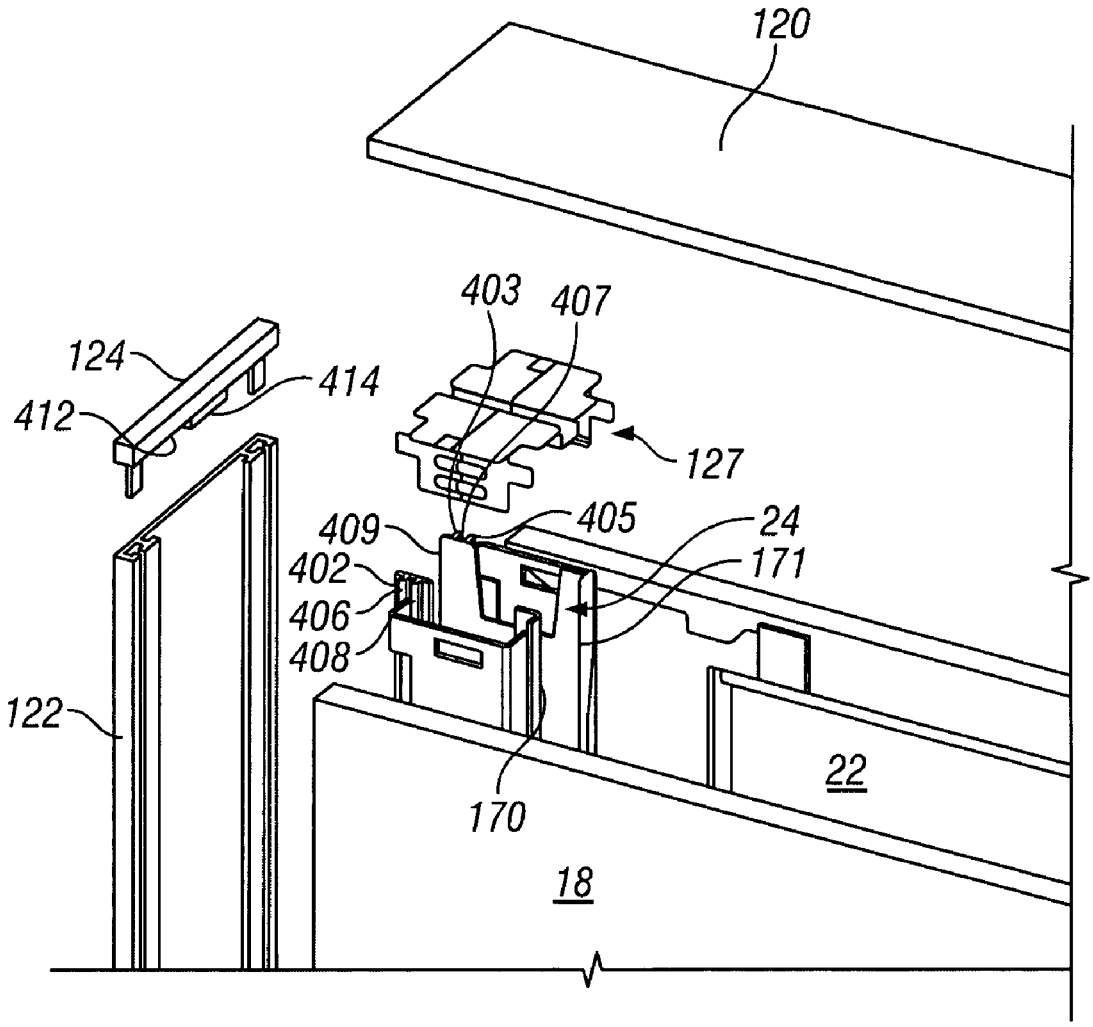
FIG. 39 is an exploded pictorial view of an upper left-hand corner of a partition similar to FIG. 19 but showing the grommet member in an extended orientation.
Figure 40:
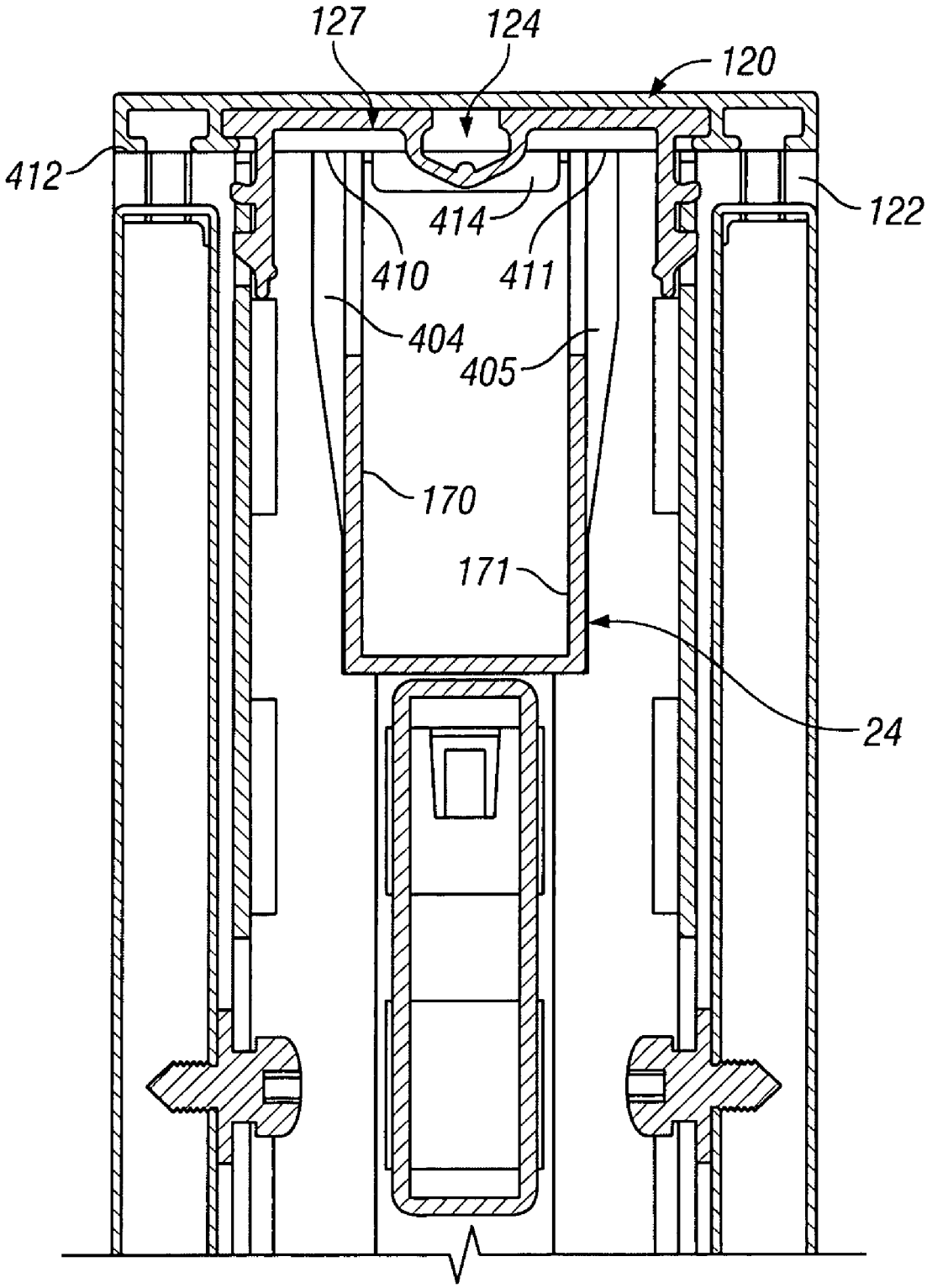
FIG. 40 is a vertical cross-sectional view similar to FIG. 11 but showing the embodiment of FIG. 39.

Reference is made to FIGS. 39 and 40 illustrating an arrangement for vertically supporting the corner cap 124 with the grommet member 24. As seen, for example, in FIG. 11, the grommet member 24 carries on the outer surface of each of its front and rear walls 170 and 171 a pair of vertically extending ribs being spaced vertical front ribs 402 and 404 on the front wall 170 and rear ribs 403 and 405 on the rear wall 171. Between the front ribs 402 and 404, a vertically extending forwardly directed front channel 406 is formed.

Between the rear ribs 403 and 405 a vertically extending rearwardly directed rear channel 407 is formed.

Figure 18:
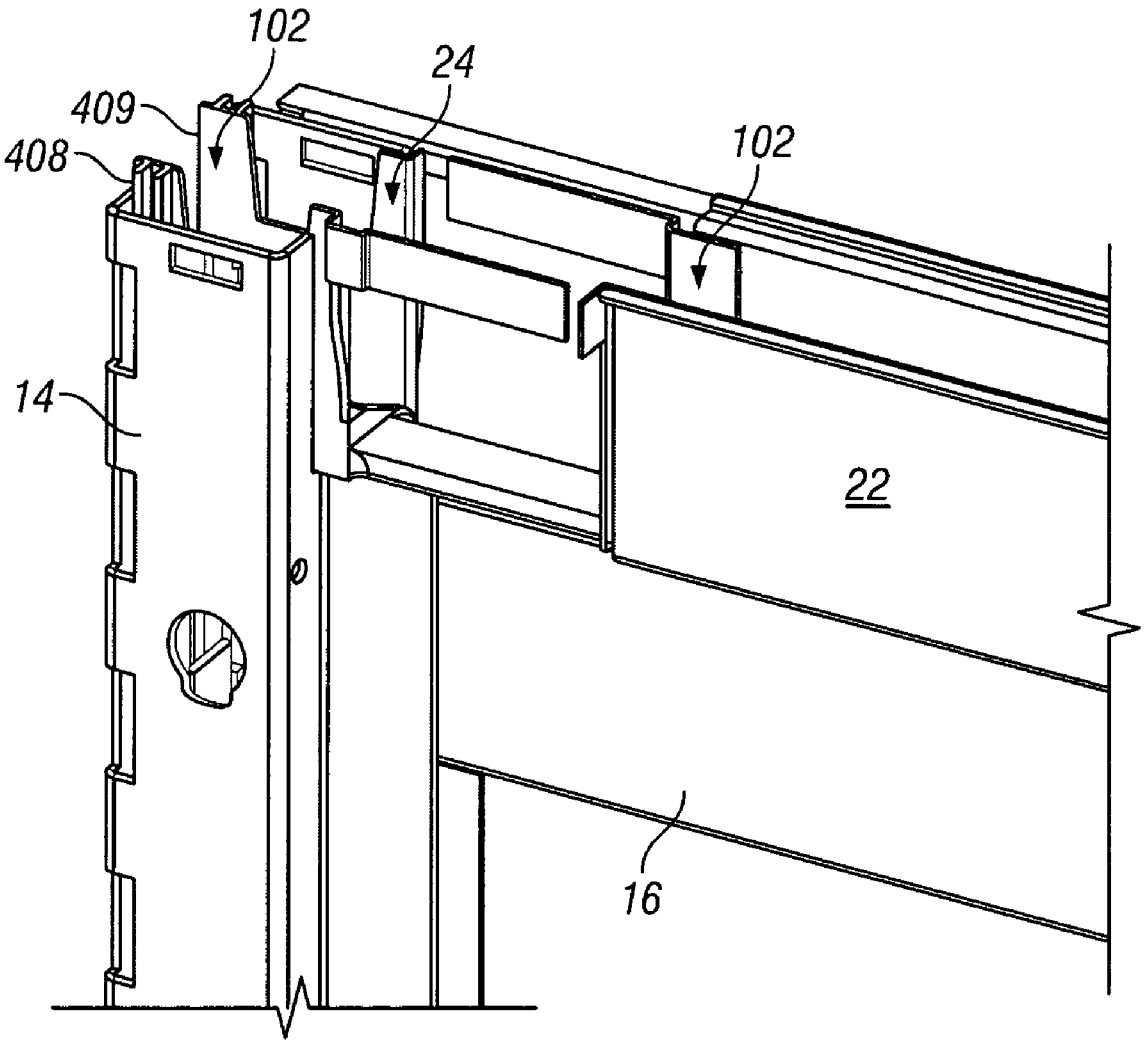
FIG. 18 is a pictorial view the same as FIG. 17 but with the grommet member installed.

The grommet member 24 may be installed in one recessed orientation as seen in FIG. 18 in which the outer edges 408 and 409 of the grommet member 24 are inside the post member 14, that is, inwardly of the bight member 32.

The grommet member 24 may be installed in an extended orientation as seen in FIG. 39 in which the bight member 32, that is, its front portion 66 or rear portion 67 on either side of the exterior top slot 91 is received in the front channel 406 and the rear channel 407, respectively, and the outer edges 408 and 409 extend beyond the bight member 32 as, for example, beyond the end surface 69 shown in FIG. 4. The portion of outer edges 408 and 409 which extend beyond the bight member 32 carry upwardly directed support surfaces 410 and 411 which engage a downwardly directed bottom surface 412 on the corner cap 124 shown in FIG. 40 so as to support the corner cap 124 at a desired vertical height.

The grommet member 24 is preferably resilient such that the front and rear walls 170 and 171 may manually be deflected towards each other sufficiently that the ribs 402, 403, 404 and 405 may move inwardly of the front or rear portions of the bight member 32 received in the channels 406 and 407 and the grommet member 24 may be manually slid horizontally between the recessed orientation of FIG. 18 and the extended orientation of FIG. 39. The grommet member 24 may be used in a recessed position, for example, for an end to end connection similar to that in FIG. 24 and in an extended position as to support a corner cap 124 as in FIGS. 39 and 40.

As seen in FIGS. 39 and 40, the corner cap 124 preferably carries a block plug member 414 which extends downwardly from the bottom surface 412 and becomes disposed between the front and rear walls 170 and 171 of the grommet member 24 when the grommet member is in the extended orientation. The block plug member 414 when received between the front and rear walls 170 and 171 prevents the front and rear walls 170 and 171 from being deflected towards each other sufficiently to disengage from having the front and rear portions of the bight member 32 received in the channels 406 and 407. With the corner cap 124 attached, the grommet member 24 cannot be moved from the extended orientation to the recessed orientation.

In the embodiment of FIGS. 39 and 40, the grommet member 24 supports the corner cap 124 and the post clip 127 is preferably sized so as to not extend towards the end beyond the bight member 32. In various embodiments, one or both of the grommet member and the post clip may extend beyond the bight member to support the corner cap 124 vertically.

While the reference has been described with reference to preferred embodiments, many modifications and variations will now occur to a person skilled in the art. For a definition of the invention, reference is made to the following claims.

We claim:

1. An upright partition for use in a modular office furniture system, the partition having a first end and a second end, the partition comprising a frame comprising two spaced elongate metal vertical post members and at least two vertically spaced elongate metal beam members with the post members joined by the beam members, the two post members comprising a first post member at the first end of the partition and a second post member at the second end of the partition, each of the two post members being elongate about a respective longitudinal, a vertical longitudinal center plane passing through the partition from the first post member to the second post member with the longitudinal of each post member lying in the center plane, each post member having as seen in cross-section normal its longitudinal, an end bight member, a front leg member and a rear leg member, with the front leg member and the rear leg member each extending away from the bight member forming a slotway therebetween about the center plane with the slotway of the first post member opening towards the second post member and the slotway of the second post member opening towards the first post member, each of the beam members having a first end and a second end, the first end of each beam member having a first end face and the second end of each beam member having a second end face, each of beam members spanning between the first post member and the second post member with the first end of each beam member received in the slotway of the first post member fixedly connected to the first post member in an overlapping moment resisting connection and the second end of each beam member received in the slotway of the second post member fixedly connected to the second post member in an overlapping moment resisting connection, the front leg member including a front face portion spaced from the center plane and presenting an outwardly directed front surface directed away from the center plane, the front leg member including a front return shoulder portion spaced from the bight member by the front face portion which front return shoulder portion extends from the front face portion towards the center plane to a forward inner plane where the front return shoulder portion supports an inwardly directed front flank surface lying in the forward inner plane directed toward the center plane, the forward inner plane being parallel to the center plane and between the center plane and the front face portion, the rear leg member including a rear face portion spaced from the center plane and presenting an outwardly directed rear surface directed away from the center plane, the rear leg member including a rear return shoulder portion spaced from the bight member by the rear face portion which rear return shoulder portion extends from the rear face portion towards the center plane to a rearward inner plane where the rear return shoulder portion supports an inwardly directed rear flank surface lying in the rear inner plane directed toward the center plane, the rearward inner plane being parallel to the center plane and between the center plane and the rear face portion, each beam member having a front outward face and a rear outward face spaced apart the same distance as the forward inner plane and the rearward inner plane, the first end of each beam member located the slotway in the first post member between the front leg member and the rear leg member with the front outward face of the beam member secured by welding to the front flank surface of the first post member, and the rear outward face of the beam member secured by welding to the rear flank surface of the first post member, and the second end of each beam member located the slotway in the second post member between the front leg member and the rear leg member with the front outward face of the beam member secured by welding to the front flank surface of the second post member, and the rear outward face of the beam member secured by welding to the rear flank surface of the second post member, wherein each slotway has an inner blind end formed by the bight member of its respective post member, the inner blind end of the slotway of the first post member having an inner bight surface directed towards the second post member, the inner blind end of the slotway of the second post member having an inner bight surface directed toward the first post member, the first end face at the first end of each beam member abuts and is secured by welding to the inner bight surface of the bight member of the first post member, and the second end face at the second end of each beam member abuts and is secured by welding to the inner bight surface of the bight member of the second post member.

2. An upright partition as claimed in claim 1 wherein the front flank surface is provided on a front flank portion which extends from the front return shoulder portion remote from the front face portion, and the rear flank surface is provided on a rear flank portion which extends from the rear return shoulder portion remote from the rear face portion.

3. An upright partition as claimed in claim 1 wherein the front flank portion extends from the front return shoulder portion away from the bight member, and the rear flank portion extends from the rear return shoulder portion away from the bight member.

4. An upright partition as claimed in claim 3 wherein each post member comprises a sheet of metal material which has been bent to assume its shape, each beam member comprises a metal tubular member, and the beam members are secured to the post members by welding.

5. An upright partition as claimed in claim 1 wherein each of the beam members elongate about a respective longitudinal with the longitudinal of each beam member lying in the longitudinal center plane.

6. An upright partition as claimed in claim 5 wherein the front surface lying in a forward outer plane parallel to the center plane, the rear surface lying in a rearward outer plane parallel to the center plane, at least one front cladding panel spanning between the two post members removably connected to the frame, each front cladding panel having an inner face, each front cladding panel coupled to the frame with the inner face of each front cladding panel closely overlying to the front face portion of each post member, at least one rear cladding panel spanning between the two post members removably connected to the frame, each rear cladding panel having an inner face, each rear cladding panel coupled to the frame with the inner face of each rear cladding panel closely overlying the rear face portion of each post member, an internal cavity defined between the two post members between the forward outer plane and the rearward outer plane inward of the inner face of the front cladding panel and the inner face of the rear cladding panel, a vertically extending front raceway defined within the internal cavity outward of the front outward faces of the beam members and inward of the inner face of each front cladding panel, a vertically extending rear raceway is defined within the internal cavity outward of the rear outward faces of the beam members and inward of the inner face of each rear cladding panel.

7. An upright partition as claimed in claim 6 wherein the inner face of each front cladding panel is secured to the front outward face of each post member, and the inner face of each rear cladding panel is secured to the rear outward face of each post member.

8. An upright partition as claimed in claim 6 including at least one horizontally extending raceway defined within the internal cavity providing for communication between the front raceway and the rear raceway either above or below at least one of the beam members.

9. An upright partition as claimed in claim 8 wherein the beam members comprise at least an upper most beam member and a lowermost beam member, the at least one horizontally extending raceway comprises a raceway selected from one or more of the group consisting of:

a horizontally extending raceway defined within the internal cavity between two adjacent but vertically spaced of the beam members, a horizontally extending raceway defined within the internal cavity above an uppermost of the beam members, and a horizontally extending raceway defined within the internal cavity below a lowermost of the beam members.

10. An upright partition as claimed in claim 4 wherein each post member has an upper end and a lower end, the beam members comprise at least an upper most beam member and a lowermost beam member, the upper end of each post member extends upwardly beyond the uppermost beam member, a top slot disposed about the center plane extending through the bight member of each post member from the upper end of the post member downwardly to a lower blind end, in each post member the top slot together with the slotway defining a channelway horizontally through the post member open at the upper end of the post member to permit laying in of wiring from above the post member to pass through the post member from an end of the post member to above the uppermost beam.

11. An upright partition as claimed in claim 6 wherein each post member has an upper end and a lower end, the beam members comprise at least an upper most beam member and a lowermost beam member, the upper end of each post member extends upwardly beyond the uppermost beam member, a top slot disposed about the center plane extending through the bight member of each post member from the upper end of the post member downwardly to a lower blind end, in each post member the top slot together with the slotway defining a channelway horizontally through the post member open at the upper end of the post member to permit laying in of wiring from above the post member to pass through the post member from beyond an end of the post member to the internal cavity above the uppermost beam.

12. An upright partition as claimed in claim 11 wherein the channelway in each post member together with the interior cavity above the uppermost beam member, below the upper ends of the post members, and between the inner face of the front cladding panel and the inner face of the rear cladding panel defining an upper raceway open upwardly to permit laying in of wiring from above the post members horizontally from beyond the end of the first post member across the partition to beyond the end of the second post member.

13. An upright partition as claimed in claim 1 wherein the bight member forming an end of the partition at each post, and adapted for coupling to a bight member of a similar adjoining partition for coupling of partitions end to end in line.

14. An upright partition as claimed in claim 1 wherein each post member is symmetrical about the center plane.

15. An upright partition as claimed in claim 1 wherein the front face portion is disposed in a forward outer plane parallel to the center plane, the forward inner plane being between the center plane and the forward outer plane, the rear face portion is disposed in a rearward outer plane parallel to the center plane, the rear inner plane being between the center plane and the rearward outer plane.

16. An upright partition as claimed in claim 15 wherein the front return shoulder portion extends from the front face portion inwardly from the forward outer plane to the forward inner plane, and the rear return shoulder portion extends from the rear face portion inwardly from the rearward outer plane to the rearward inner plane.

17. An upright partition for use in a modular office furniture system, the partition having a first end and a second end, the partition comprising a frame comprising two spaced elongate metal vertical post members and at least two vertically spaced elongate metal beam members with the post members joined by the beam members, the beam members comprising at least an upper most beam member and a lowermost beam member, the two post members comprising a first post member at the first end of the partition and a second post member at the second end of the partition, each of the two post members being elongate about a respective longitudinal, a vertical longitudinal center plane passing through the partition from the first post member to the second post member with the longitudinal of each post member lying in the longitudinal center plane, each post having as seen in cross-section normal its longitudinal, an end bight member, a front leg member and a rear leg member, with the front leg member and the rear leg member each extending away from the bight member forming a slotway therebetween about the center plane with the slotway of the first post member opening towards the second post member and the slotway of the second post member opening towards the first post member, each of the beam members having a first end and a second end, the first end of each beam member having a first end face and the second end of each beam member having a second end face, each of beam members spanning between the first post member and the second post member with the first end of each beam member fixedly connected to the first post member in an overlapping moment resisting connection and the second end of each beam member fixedly connected to the second post member in an overlapping moment resisting connection, the first end of the uppermost beam member received in the slotway of the first post member, the second end of the uppermost beam member received in the slotway of the second post member, the front leg member including a front face portion spaced from the center plane and presenting an outwardly directed front surface directed away from the center plane, the front leg member including a front return shoulder portion spaced from the bight member by the front face portion which front return shoulder portion extends from the front face portion towards the center plane to a forward inner plane where the front return shoulder portion supports an inwardly directed front flank surface lying in the forward inner plane directed toward the center plane, the forward inner plane being parallel to the center plane and between the center plane and the front face portion, the rear leg member including a rear face portion spaced from the center plane and presenting an outwardly directed rear surface directed away from the center plane, the rear leg member including a rear return shoulder portion spaced from the bight member by the rear face portion which rear return shoulder portion extends from the rear face portion towards the center plane to a rearward inner plane where the rear return shoulder portion supports an inwardly directed rear flank surface lying in the rear inner plane directed toward the center plane, the rearward inner plane being parallel to the central plane and between the center plane and the rear face portion, the uppermost beam member having a front outward face and a rear outward face spaced apart the same distance as the forward inner plane and the rearward inner plane, the first end of the uppermost beam member located the slotway in the first post member between the front leg member and the rear leg member with the front outward face of the uppermost beam member secured by welding to the front flank surface of the first post member, and the rear outward face of the uppermost beam member secured by welding to the rear flank surface of the first post member, and the second end of the uppermost beam member located the slotway in the second post member between the front leg member and the rear leg member with the front outward face of the uppermost beam member secured by welding to the front flank surface of the second post member, and the rear outward face of the uppermost beam member secured by welding at least to the rear flank surface of the second post member, wherein each slotway has an inner blind end formed by the bight member of its respective post member, the inner blind end of the slotway of the first post member having an inner bight surface directed towards the second post member, the inner blind end of the slotway of the second post member having an inner bight surface directed toward the first post member, the first end face at the first end of each beam member abuts and is secured by welding to the inner bight surface of the bight member of the second post member.

18. An upright partition as claimed in claim 17 wherein the front surface lying in a forward outer plane parallel to the center plane, the rear surface lying in a rearward outer plane parallel to the center plane, at least one front cladding panel spanning between the two post members removably connected to the frame, each front cladding panel having an inner face, each front cladding panel coupled to the frame with the inner face of each front cladding panel closely overlying to the front face portion of each post member, at least one rear cladding panel spanning between the two post members removably connected to the frame, each rear cladding panel having an inner face, each rear cladding panel coupled to the frame with the inner face of each rear cladding panel closely overlying the rear face portion of each post member, an internal cavity is defined between the two post members between the forward outer plane and the rearward outer plane inward of the inner face of the front cladding panel and the inner face of the rear cladding panel, a vertically extending front raceway is defined within the internal cavity outward of the front outward face of the uppermost beam member and inward of the inner face of each front cladding panel, a vertically extending rear raceway is defined within the internal cavity outward of the rear outward face of the uppermost beam member and inward of the inner face of each rear cladding panel.

19. An upright partition as claimed in claim 18 wherein each post member has an upper end and a lower end, the upper end of each post member extends upwardly above the uppermost beam member, a slot disposed about the center plane extending through the bight member of each post member from the upper end of the post member, in each post member the slot together with the slotway defining a channelway horizontally through the post member open at the upper end of the post member to permit laying in of wiring from above the post member to pass through the post member from an end of the post member to the internal cavity above the uppermost beam.

20. An upright partition as claimed in claim 19 wherein the channelway in each post member together with the interior cavity above the uppermost post beam below the upper ends of the post members and between the inner face of the front cladding and the inner face of the rear cladding defining an upper raceway open upwardly which permits laying in of wiring from above the post member horizontally from beyond the end of the first post member across the partition to beyond the end of the second post member, and the vertically extending front and rear raceway permits wiring from the upper raceway to pass vertically past the uppermost beam member within the internal cavity.

21. An upright partition as claimed in claim 12 wherein each of the vertically extending front and rear raceway permits wiring from the upper raceway to pass vertically past each of the beam member within the internal cavity and throughout the entire height of the partition between the upper end and the lower end of the post members.

* * * * *